US005231645A

United States Patent [19]

Uno et al.

[11] Patent Number: 5,231,645

[45] Date of Patent: Jul. 27, 1993

[54] METHOD OF CONTROLLING CONTINUOUS CARBURIZATION FURNACE

[75] Inventors: Kazuo Uno; Makoto Sumitomo, both of Nagoya, Japan

[73] Assignee: Toyota Jidosha Kabushiki Kaisha, Japan

[21] Appl. No.: 900,498

[22] Filed: Jun. 18, 1992

[30] Foreign Application Priority Data

Jun. 19, 1991 [JP] Japan ..... 3-147320

[51] Int. Cl.[5] ..... C23C 11/12; H05B 1/02

[52] U.S. Cl. ..... 373/136; 266/80; 266/90; 148/215; 432/37; 364/477

[58] Field of Search ..... 373/135, 136; 266/249, 266/250, 252, 78–80, 90, 44; 148/215; 219/388, 494; 432/18, 37

[56] References Cited

U.S. PATENT DOCUMENTS

| | | | |
|---|---|---|---|
| 3,868,094 | 2/1975 | Hovis | 432/54 |
| 4,257,767 | 3/1981 | Price | 266/80 |
| 4,306,919 | 12/1981 | Roberge et al. | 148/215 |
| 4,501,552 | 2/1985 | Wakamiya | 364/477 |
| 4,605,161 | 8/1986 | Motomiya et al. | 219/388 |

FOREIGN PATENT DOCUMENTS

| | | | |
|---|---|---|---|
| 3139622 | 4/1983 | Fed. Rep. of Germany | 148/215 |
| 60-208469 | 10/1985 | Japan . | |
| 61-231157 | 10/1986 | Japan . | |
| 817569 | 3/1981 | U.S.S.R. | 266/80 |
| 1062307 | 12/1983 | U.S.S.R. . | |

*Primary Examiner*—Bruce A. Reynolds
*Assistant Examiner*—John A. Jeffrey
*Attorney, Agent, or Firm*—Finnegan, Henderson, Farabow, Garrett & Dunner

[57] ABSTRACT

In the continuous carburization furnace in which the temperature of the heaters can be controlled individually at every carburization processing position; carburization reference data at each carburization processing position is read; a temperature and carbon potential at each position at least during carburization and diffusion processes is detected; a carburized quantity of the processed member at each position is calculated with reference to the detected temperature and carbon potential; a carburization history is calculated by integrating the carburized quantity at each position of the carburization processed member, and a carburizing condition at a next carburization processing position is determined depending on a difference between the carburization history at the time of terminating the carburization process at each position of the carburization processed member and the carburization reference data at each position. In this way, a fluctuation of the carburizing condition based on a history of the carburization degree at each carburizing position is reduced and the productivity rate of the continuous carburization furnace is improved without stagnation of processing even upon changing a carburizing condition.

12 Claims, 26 Drawing Sheets

Co ··· ORIGINAL QUANTITY OF SAMPLE
C1 ··· CASE CARBON POTENTIAL
Dc ··· CARBURIZED DEPTH
Fc ··· CARBON POTENTIAL DISTRIBUTION CURVE
Ic ··· CARBON INTEGRATED VALUE

T, CP CONTROL AT POSITION M
1501
CN = 0 ?
YES
NO
1502
M−3≤CN≤M−1 ?
YES
NO
1503
CONTINUED TO NEXT
802
OPERATE HEATER TEMPERATURE ThM AND CARBON POTENTIAL CPM AT POSITION M
APPLYING CARBON INTEGRATED VALUE IcM−1 AND CARBURIZED DEPTH DcM−1 OPERATED AT POSITION M−1
803
ThM > ThrMN ?
YES
NO
806
ThM ← ThrM
804
CPM > CPrMN ?
YES
NO
805
CPM ← CPr6M

METHOD OF CONTROLLING CONTINUOUS CARBURIZATION FURNACE

BACKGROUND OF THE INVENTION

1) Field of the invention

The present invention relates to a method of controlling a continuous carburization furnace, and in more particular to a method of controlling the continuous carburization furnace when members to be carburized are changed into members of a different kind having a different carburizing condition.

2) Description of the Related Art

Conventionally, for structural components, a case hardening process which is referred to as carburization has been executed wherein the case layer is hardened but the core remains tenacious. As a result, the process provides an anti-shock characteristic in that an inside tenaciousness reinforces the brittleness of the hardened case with a resistivity against wear.

FIG. 1 is a schematic structural view of the conventional pusher type continuous carburization furnace for carrying out the carburization process using a gas suitable for carburization. The continuous carburization furnace is normally divided into zones for partitioning a temperature and a furnace atmosphere by a partitioning arch W. The furnace includes a temperature rising zone, a carburization zone, a diffusion zone and a quench hardening zone. The member to be carburizably processed is placed on a tray TR by a jig etc., and inserted sequentially into the furnace from an inlet by means of the pusher Pl. For example in this furnace, thirteen trays TR are provided from the temperature rising zone to the diffusion zone in the furnace and pushed by the pusher Pl to move at a predetermined distance in the furnace every time the predetermined time lapses and to stop at the thirteen carburization positions during the foregoing predetermined interval, thereby performing the carburization. The trays TR pushed out from the diffusion zone are inserted into the quench hardening zone by the pusher P2 and are moved in the quench hardening zone by the pusher P3 to reach an outlet.

In the carburization furnace constituted as described above, a turn ON and OFF control of a heater H by a heater control or an adjustment of the inclusion amount of butane gas to the gas from a gas inlet G by means of an atmospheric gas control is executed so that the temperature and carbon potential detected by a detector S are obtained to satisfy the characteristics as shown in FIGS. 2 and 3, the carbon potential (a carburized depth) of the member to be carburized is thus adjusted. For example, the carburized depth (the carbon potential) of automobile parts are 1.5 mm or more for cam shafts and piston pins, and in the order of 1.0 to 1.5 mm for ring gears, bearing rollers and transmission gears, and further 0.5 mm or less for push rods and shackle bolts.

However, in the conventional continuous carburization furnace, when the conditions of respective zones vary with each change of the members to be processed, a number of vacant trays must be sent until the time when the immediately previous processed members are discharged and the time when the previous conditions of the respective zones become new conditions for the next members to be carburizably processed, a problem thus arises because such a process degrades the productivity of the carburization furnace. In this case, if the members to be processed with the other different conditions are inserted continuously into the furnace without sending the vacant trays, a disadvantage occurs in that the carburized depth of the member fluctuates, i.e., increased more than or lowered less than the reference carburized depth of the member.

Further, in the control of the conventional continuous carburization furnace, since the operational conditions of the respective zones are controlled to set the temperature and the carburization potential at a constant value and not controlled based on the temperature or atmospheric conditional information received by each tray, then changes of the operational conditions cause fluctuations of the carburized depths as it is.

To prevent the fluctuation of the carburized depths when placed on every tray, in the conventional method, it is determined whether or not the carburized depth at every tray is satisfactory by using the test members, i.e., the carburized depth of an object to be determined that is placed on each tray is estimated by measuring the carburized depths of the test members that are placed on the trays and carburized under the same conditions. Therefore, this conventional method requires excess test members and a lot of time for measuring the carburizing degree of the test members, and has often resulted in defective products.

SUMMARY OF THE INVENTION

An object of the present invention is to realize a method of controlling a continuous carburization furnace capable of reducinq fluctuation of the carburizing condition and improving the productivity without stagnation of the carburizing process by changing the operational conditions of the respective zones based on the history of the carburization degree that is obtained at each carburizing position and computed on the basis of the temperature and the atmosphere on which the carburized members on each tray are exposed at the respective carburizing positions.

According to the present invention, there is provided a method of controlling a continuous carburization furnace comprising a temperature rising zone, a carburization zone, a diffusion zone, a rapid quench treatment zone, and a quench hardening zone, wherein heaters of at least the carburization zone and the diffusion zone can be controlled individually at every stop position of a tray containing a member to be carburized and the carburization processing is executed to move the tray intermittently within the continuous carburization furnace, said method of controlling the continuous carburization furnace comprises reading carburization reference data at each carburization processing position of the carburization processed member, detecting a temperature and a carbon potential at each position within a furnace at least during carburization and diffusion processes, operating a carburized quantity of the member to be carburized at each position with reference to the detected temperature and carbon potential, operating the carburization history of the member to be carburized by integrating the carburized quantity at each position of the member to be carburized, determining a carburizing condition at a next carburization processing position depending on the difference between the carburization history at the time of terminating the carburization process at each position of the member to be carburized and the carburization reference data at said each position.

According to the method of controlling the carburization furnace in accordance with the present invention, the amount of carburization at the respective positions of the member to be carburizably processed is accumulated to be computed to produce a carburization history, on the basis of which the carburizing condition of the carburization furnace is controlled, therefore the members to be carburized come to have a reduced fluctuation. After the minimized number of vacant trays have been sent for exchanging a stage for a different member to be carburized in the continuous carburization furnace, the next member having a different carburizing condition is sent to the furnace during the time when the processed member with the immediately previous condition is present in the furnace, and by measuring the carburization history in each carburizing position, the carburizing conditions at each carburizing position are gradually varied, and at the last carburizing position the discharge from the furnace is executed at the same conditions that the carburization is first performed at the carburizing conditions of the next member, thereby minimizing the amount of stagnation of the carburizing process when exchanging the stage.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
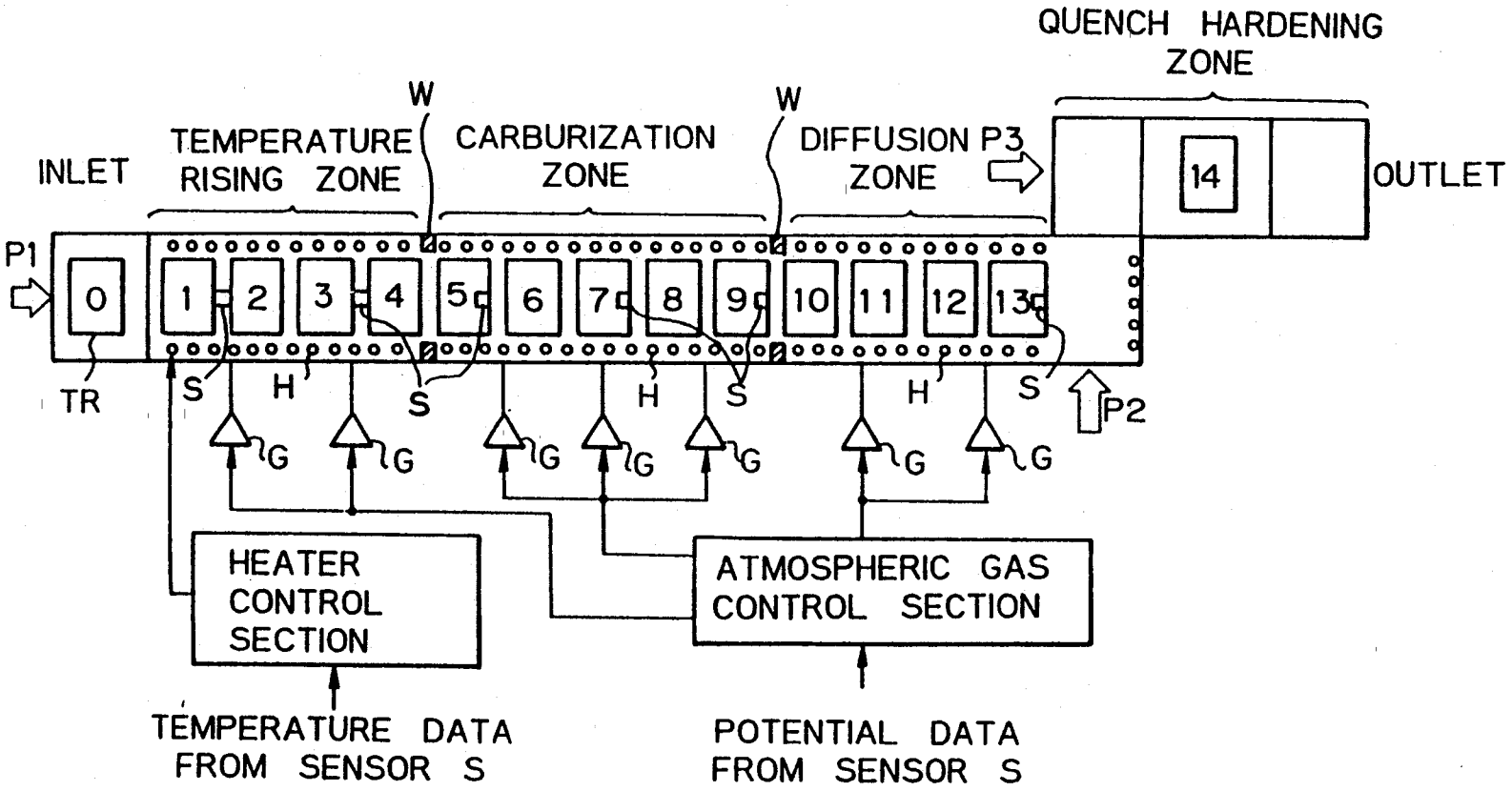
Fig. 1 PRIOR ART
FIG. 1 is a constitutional view showing the conventional continuous carburization furnace.
Figure 2:
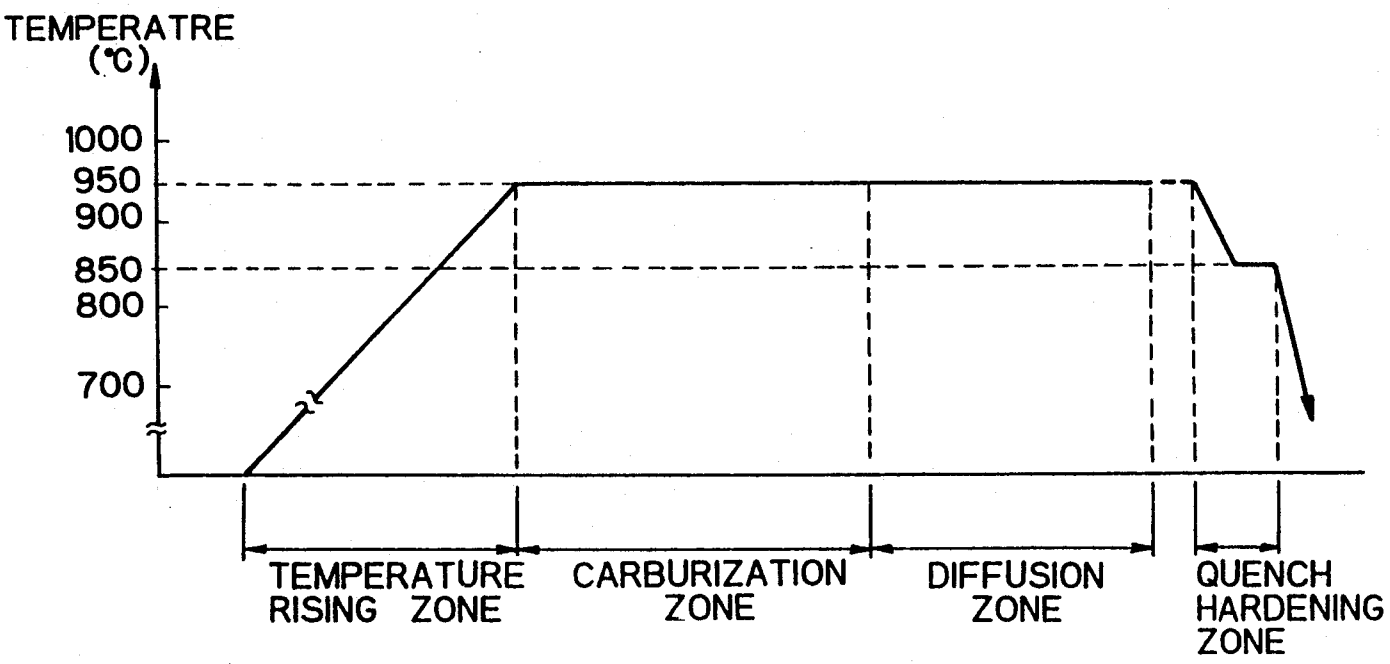
Fig. 2 PRIOR ART
FIG. 2 shows a transition of a temperature at each zone of the conventional continuous carburization furnace.
Figure 3:
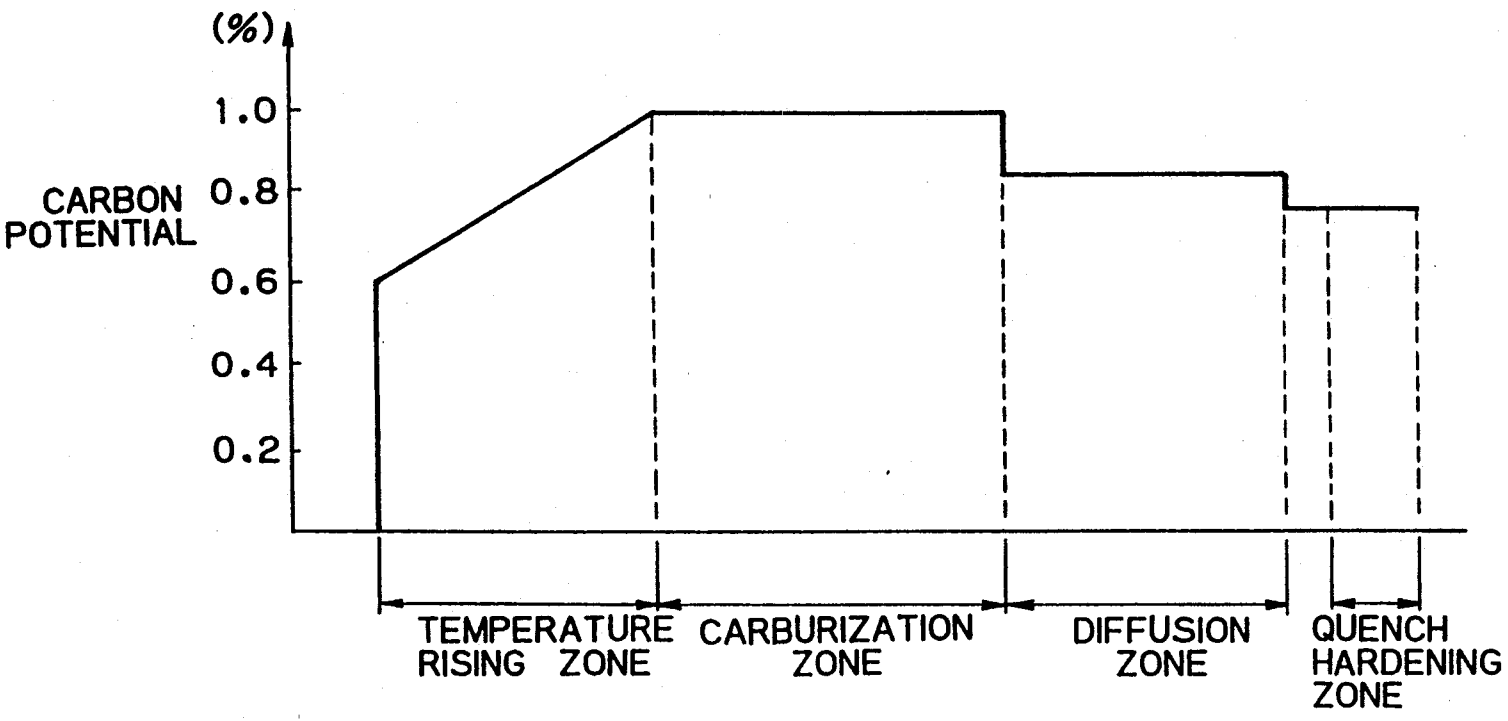
Fig. 3 PRIOR ART
FIG. 3 shows a variation of a carbon potential at each zone of the conventional continuous carburization furnace.

FIG. 1 is a structural view of a continuous carburization furnace for embodying a method of controlling the continuous carburization furnace according to the present invention, where throughout the description, the identical references used in connection with the drawings indicate like constituent elements for the conventional carburization furnace.

Figure 4:
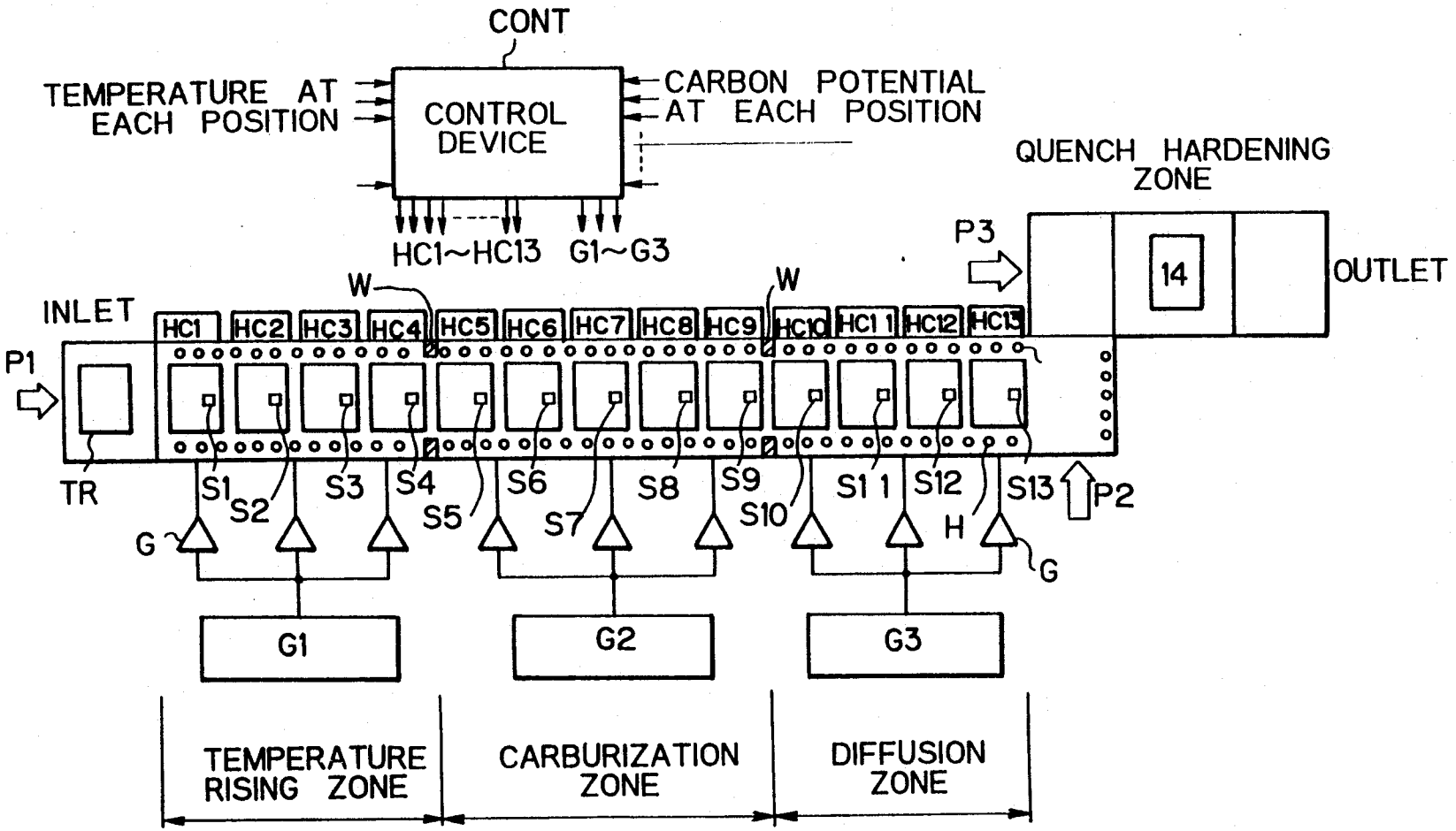
FIG. 4 is a constitutional view of a continuous carburization furnace embodying a method of controlling a carburization furnace according to the present invention.

In the continuous carburization furnace of FIG. 4, a temperature rising zone, a carburization zone and a diffusion zone are respectively partitioned by a partitioning arch W to prevent atmospheric gas from flowing through each other. The flow of the atmospheric gas into each zone is operated from a gas inlet G, and the atmospheric gas potential at every zone is adjusted by an atmospheric gas control device G1 to G3. A heater H is controlled individually by heater control devices HC1 to HC13 provided at every stop position of trays TR for carrying members to be carburized. The atmospheric gas control devices G1 to G3 and the heater control devices HC1 to HC13 are controlled by a control device CONT, to which temperature information and carbon potential information from sensors S1 to S13 provided on each stop position of the trays TR are input. Based on the temperature information and the carbon potential information, the control device CONT determines a temperature of each heater and an atmospheric gas potential of each zone to produce an optimum carburizing condition for the carburized member now under carburization, and sends the control information to the atmospheric gas control devices G1 to G3 and the heater control devices HC1 to HC13.

Reference numerals P1, P2 and P3 depict pushers, each tray TR is inserted sequentially into the furnace through an inlet by means of the pusher P1. In an example of this furnace, thirteen pieces of trays TR are provided from the rising zone to the diffusion zone within the furnace, and the trays TR are pushed by the pusher P1 every time the predetermined time lapses to be moved correspondingly at every predetermined distance within the furnace, and in this way the trays TR stop at each thirteen carburizing-positions each during every predetermined time previously described, and carburization is thus performed. The trays TR pushed out from the diffusion zone are inserted into a quench hardening zone by the pusher P2 to be moved within the quench hardening zone by the pusher P3 to reach an outlet, as is the case of the conventional furnace.

A method of the present invention controlling the carburization furnace constituted as described in the foregoing will be described hereinafter. First, a method of historical control according to the present invention wherein the member to be processed is changed and the condition at every zone must accordingly be changed in the case of a continuous carburization furnace continuing the same carburizing process as in the conventional furnace is explained. And next, another method of historical control according to the present invention wherein carburization is always performed in consideration of the history of the carburized member irrespective of the kinds of the carburized member is explained.

(1) The case such that the historical control is performed only when the member to be carburized is changed.

Figure 5:
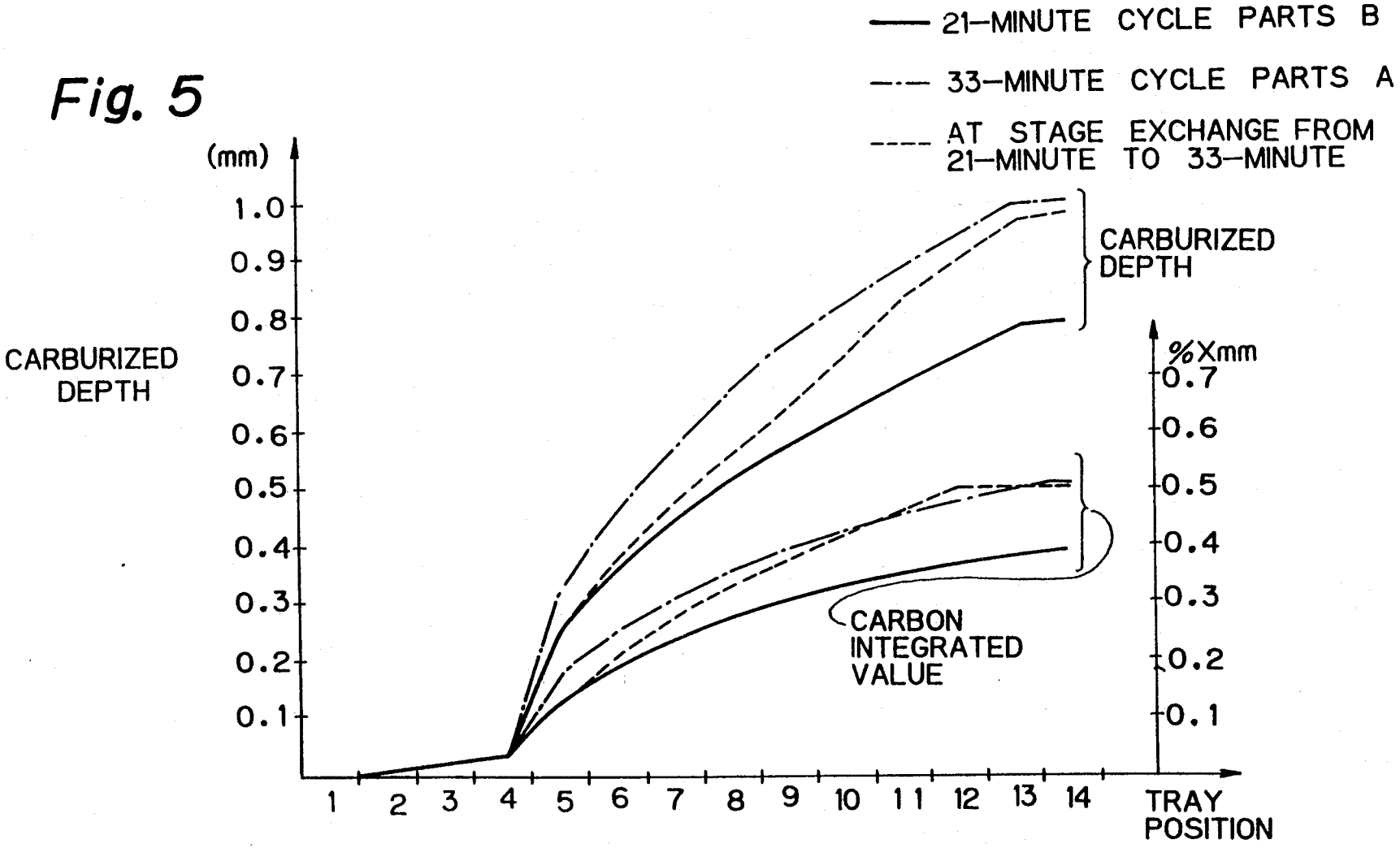
FIG. 5 shows a carburized depth and a carbon integrated value each relative to a tray position.
Figure 6:
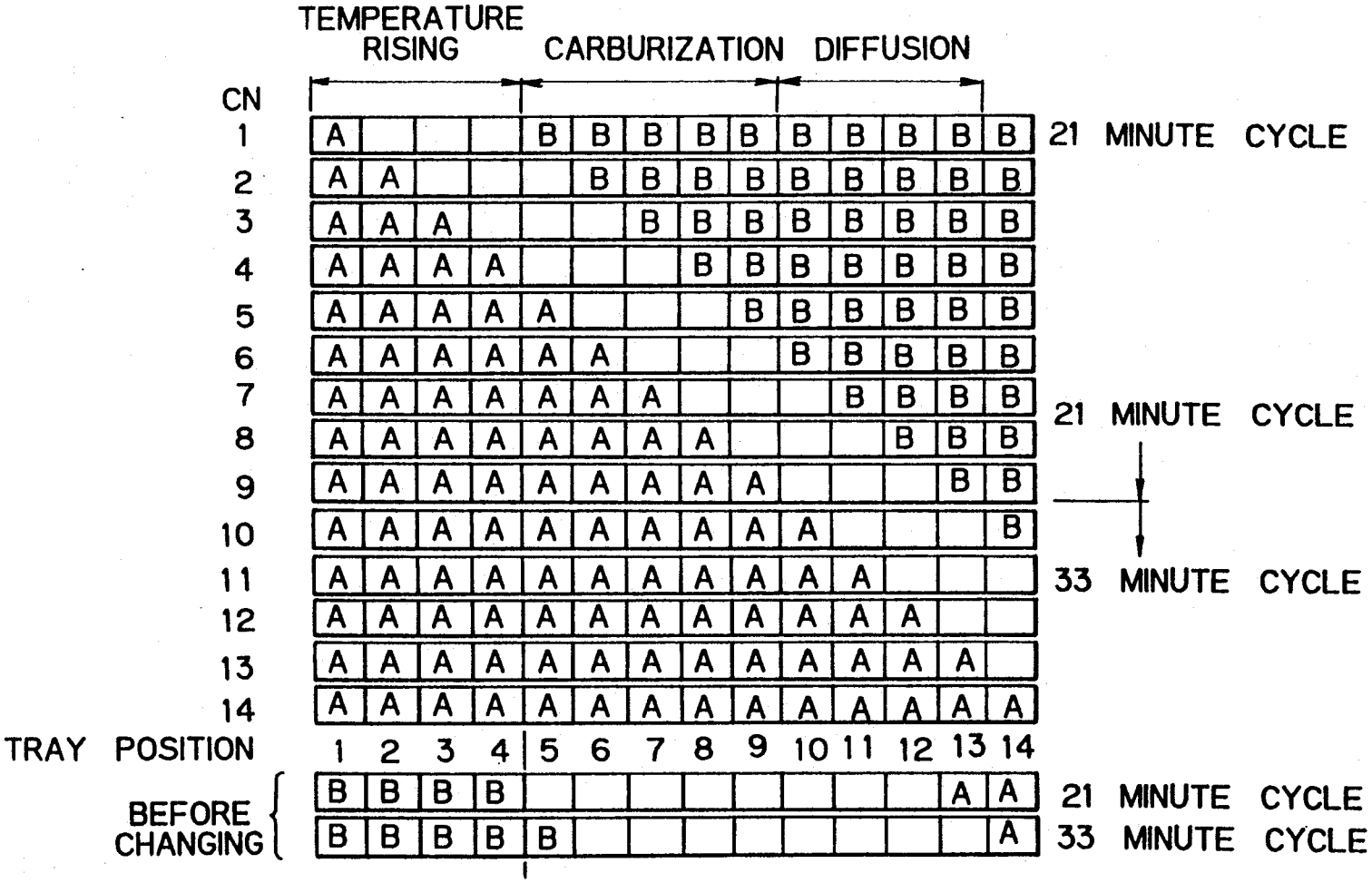
FIG. 6 shows a transition of a member to be carburized within the carburization furnace when a carburizing condition is changed.

In this control, a continuous operation is performed to prevent the sending of a vacant tray as much as possible when the carburizing condition is changed: the control will be described with reference to each tray position related to a transition of a carburized depth and a carbon integrated value as shown in FIG. 5, a transition of the tray as shown in FIG. 6, and flowcharts as shown in FIGS. 7 to 13.

As shown in FIGS. 5 and 6, symbols B are 21-minute cycle members that are moved at every 21-minute interval and symbols A are 33-minute cycle members that are moved at every 33-minute interval. If the 21-minute cycle members are moved at every specified interval to perform the carburization, the carburized depth and the carbon integrated value are as shown by solid lines in FIG. 5. If the 33-minute cycle members are moved at every specified interval to perform the carburization, the carburized depth and the carbon integrated value are as shown by a dash and dot lines in FIG. 5. It is a method according to the present invention that when the carburization is performed on the course of the 21-minute cycle operation by inserting the 33-minute cycle member A, the carburized depth and the carbon integrated value each of the 33-minute cycle member A are controlled as shown by dotted lines in FIG. 5; the three vacant trays are assumed to be sent out as shown in FIG. 6 when changing the carburizing condition.

Figure 7:
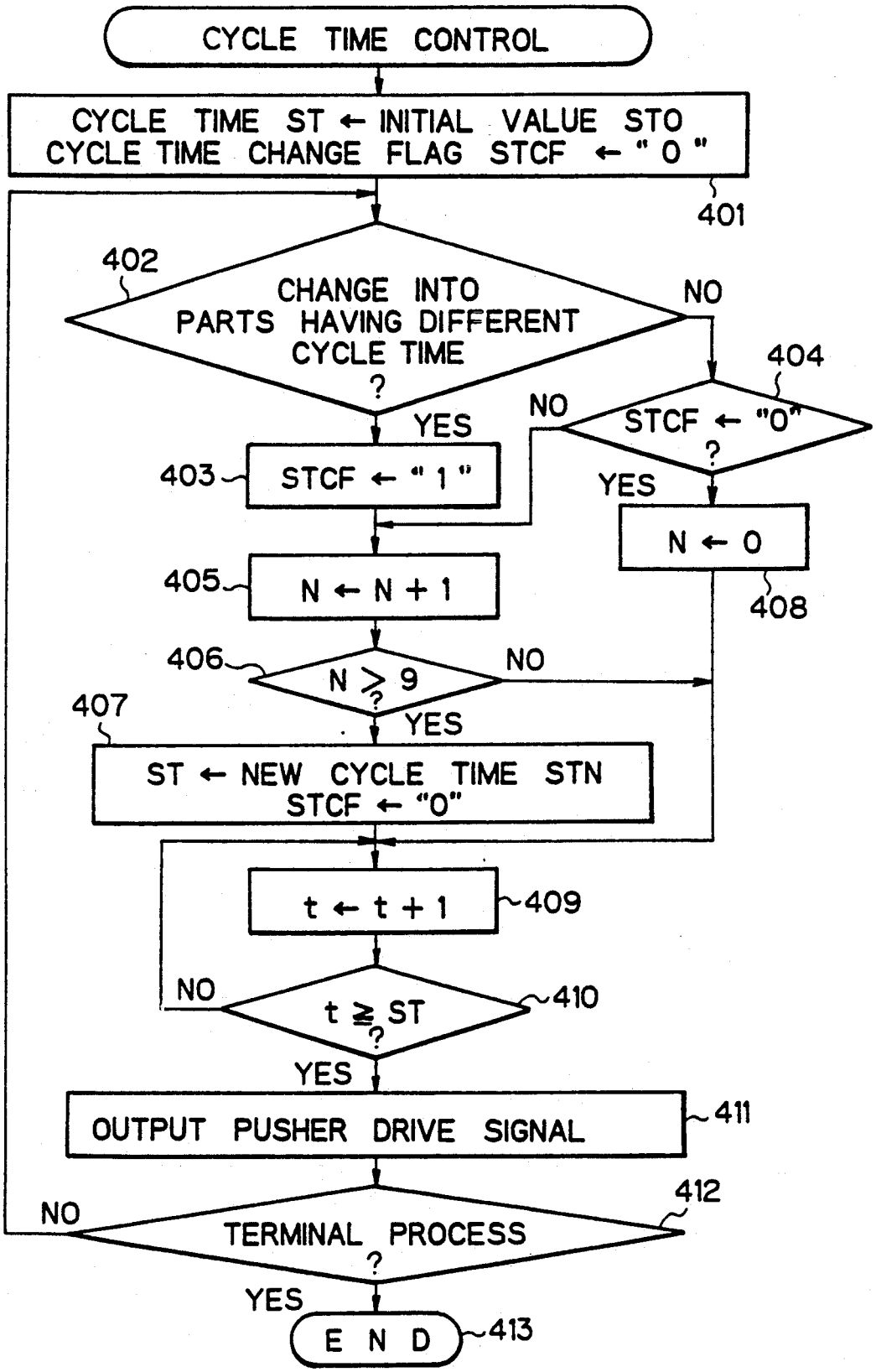
FIG. 7 is a flowchart showing a cycle time control.

FIG. 7 is a flowchart showing a cycle time control. At step 401, an initial value ST0 (for example, 21 minutes) is changed into a cycle time ST and a cycle time change flag STCF is made "0". At the next step 402, it is determined whether or not the member is changed into one having a different cycle time. It is determined whether or not the member is changed into one having a different cycle time by an input from an operator of the furnace.

In the case that the cycle time ST is not changed, the control proceeds to step 404 and it is determined whether or not the cycle time change flag STCF is "0". In this case the cycle time ST should not be changed and the control proceeds to step 408 to clear counter N and further proceeds to step 409. At step 409, the time "t" is counted and at step 410 it is determined whether or not the counted time reaches the cycle time ST. If it does not reach the cycle time ST, counting the time at step 409 is repeated, and if it reaches the cycle time ST, the control proceeds to step 411 to output a pusher drive signal. At step 412 it is determined whether or not all the carburization processes are terminated. If it is still under operation, the control returns to step 402 to repeat the foregoing procedure. In this way, the control provides the operation of the pusher at every cycle time ST, the movement of the tray, and the movement of the member to be carburized within the furnace.

In the case that the cycle time is changed into the different member; even when the member having a different cycle time is inserted into the furnace, the cycle time cannot be changed immediately because the members having an old cycle time still remain in the furnace as shown in FIG. 6. Such procedures for changing are shown at steps 403, and 405 to 407. If the cycle time ST is changed, the control proceeds from step 402 to step 403 to make the cycle time change flag STCF "1", and at the next step 405 the counter N is incremented by "1" to proceed to step 406. At step 406 it is determined whether or not the counted value of the counter N exceeds 9, and it is also determined whether or not all the carburization processed members of the old cycle time are discharged from the diffusion zone. If the measured value of the counter N is not 10, the carburization processed members of the old cycle time remain in the furnace, and the control proceeds to step 409 to perform the same process as described foregoing without changing the cycle time. On the other hand, at step 406 if N is larger than 9, the control proceeds to step 407 to replace the cycle time ST by a new cycle time STN (for example, 33 minutes), the cycle time change flag STCF is allowed to return to "0", and the control proceeds to step 409. Accordingly, the control thereafter proceeds to step 411 at every new cycle time STN to output the drive signal of the pusher.

Figure 8A:
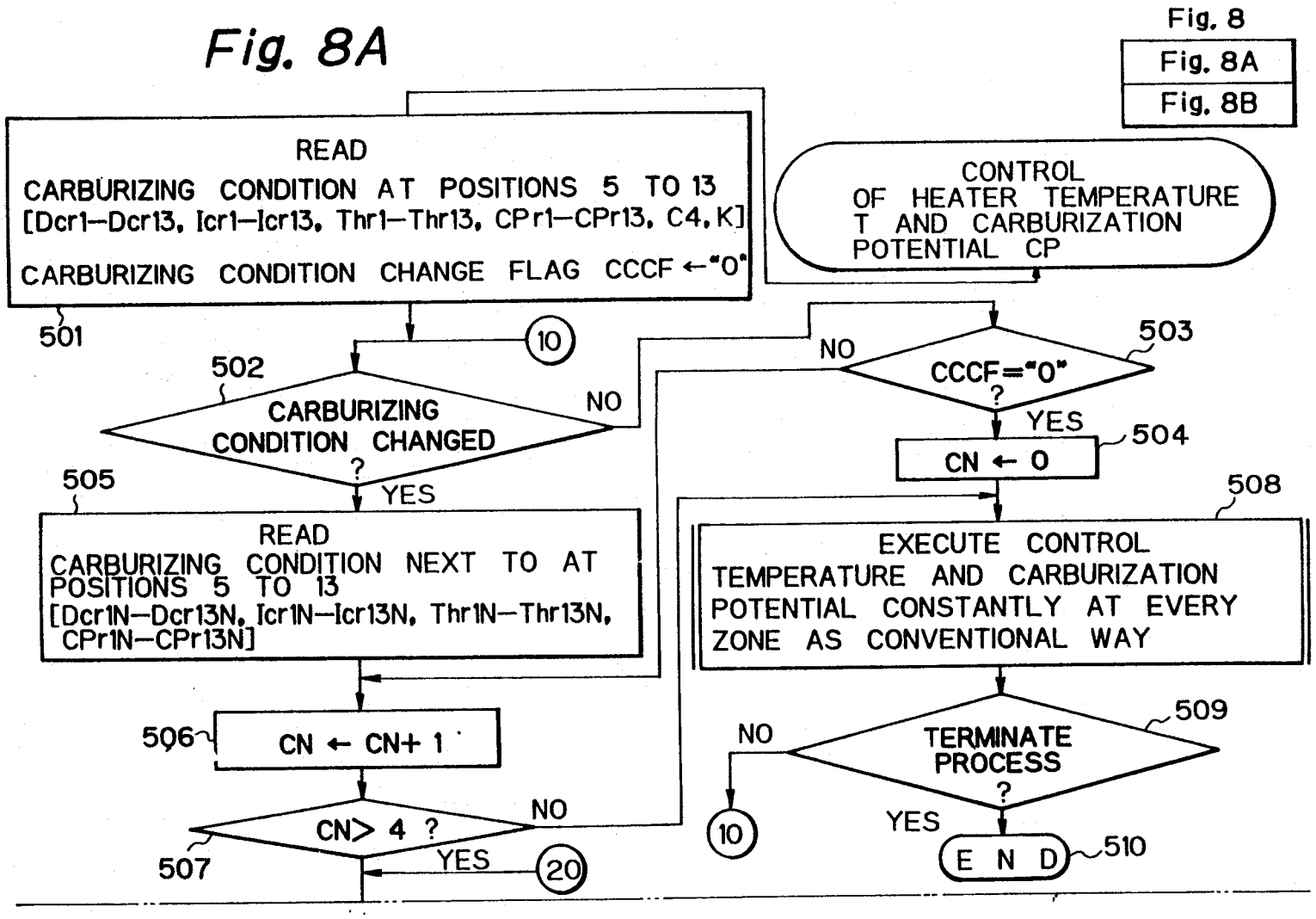
FIGS. 8A and 8B are flowcharts showing a control of heater temperature and carbon potential of a first embodiment.
Figure 8B:
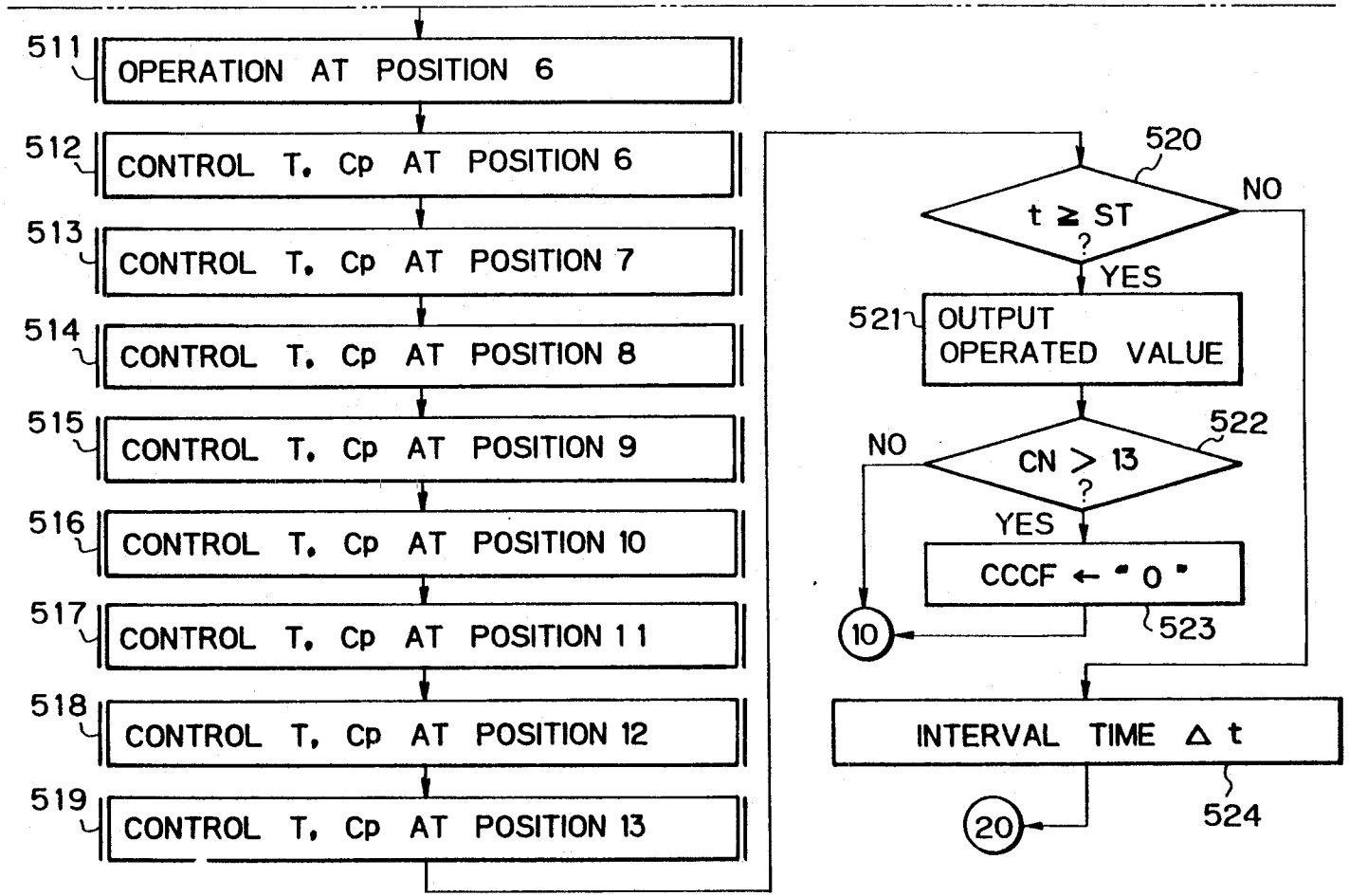

FIGS. 8A and 8B are flowcharts showing a control of a heater temperature T and a carbon potential CP. At step 501, the operation provides the read of the carburizing condition of carburizing positions 5 to 13 and concurrently provides a value of "0" for a carburizing condition change flag CCCF. This carburizing condition includes carburized depth reference values of Dcr1 to Dcr13 of the carburization processed member, carbon integrated reference values of Icr1 to Icr13, heater temperature reference values of Thr1 to Thr13, carbon potential reference values of CPr1 to CPr13, a carbon potential distribution C4 of the members up to the carburizing position 4, and a reaction factor K. At step 502, it is determined whether or not the carburizing condition is changed, namely, whether or not it is changed into a member having a different carburizing condition.

If the carburizing condition is not changed, the control proceeds to step 503, and since the carburizing condition change flag CCCF is "0", at step 504 the value of the counter CN is cleared to proceed to step 508, where, similar to the conventional furnace, it executes a control for maintaining the temperature and the carbon potential at a constant value at every zone basis. At step 509, it is determined whether or not the carburization processes all terminate (the operation terminates). If it is terminated, this routine is terminated at step 510, but if it is not terminated, the control returns to step 502 to repeat the processing.

On the other hand, if it is changed into a member having a different carburizing conditions, the control proceeds from step 502 to step 505, the control provides the read of the carburizing conditions of the next member having the different carburizing conditions in the carburizing positions 5 to 13, and makes the carburizing condition change flag CCCF "1". This carburizing condition includes carburized depth reference values Dcr1N to Dcr13N of the next member, carbon integrated reference values of Icr1N to Icr13N, heater temperature reference values of Thr1N to Thr13N, and carbon potential reference values of CPr1N to CPr13N. In step 506, the counter value CN is incremented by one, and at step 507 it is determined whether or not the measured value of the counter CN exceeds 4. This decision is required according to the present invention because the control is not performed in the temperature rising zone. Therefore, until the measured value of the counter CN becomes 5, the control proceeds to step 508 to execute an adjustment for maintaining the temperature and the carbon potential at a constant value at every zone basis, which is similar to the conventional example, and if the measured value of the counter CN exceeds 5, the control proceeds on to and after step 511.

Step 511 is for an operation at the position 5, steps 512 to 519 show the control of the heater temperature T and the carbon potential CP each at the carburizing positions 5 to 13; the detail of which will be hereinafter described with respect to every position.

After the processes of steps 511 to 519 are terminated, it is determined whether or not the cycle time ST lapses at step 520. If the cycle time ST does not lapse, the control proceeds to step 524 and returns to step 511 after an adjustment of an interval time Δ t to repeat the processing of steps 511 to 519. On the other hand, when the cycle time ST lapses at step 520, the control proceeds to step 521 and the value operated at steps 511 to 519 is output, and at step 522 it is determined whether or not the value of the counter CN exceeds 13. The decision at step 522 is for determining whether or not the diffusion zone is filled with the new carburization processed member. In the case that CN is less than or equal to 13, the control returns to step 502, and if CN is more than 13, the control proceeds to step 523 to make the carburizing condition change flag CCCF "0". As a result, the control thereafter provides YES at step 503 to execute an adjustment for maintaining the temperature and the carbon potential at a constant value at every zone basis under the condition of the new carburized member, which is similar to the conventional furnace.

Figure 9:
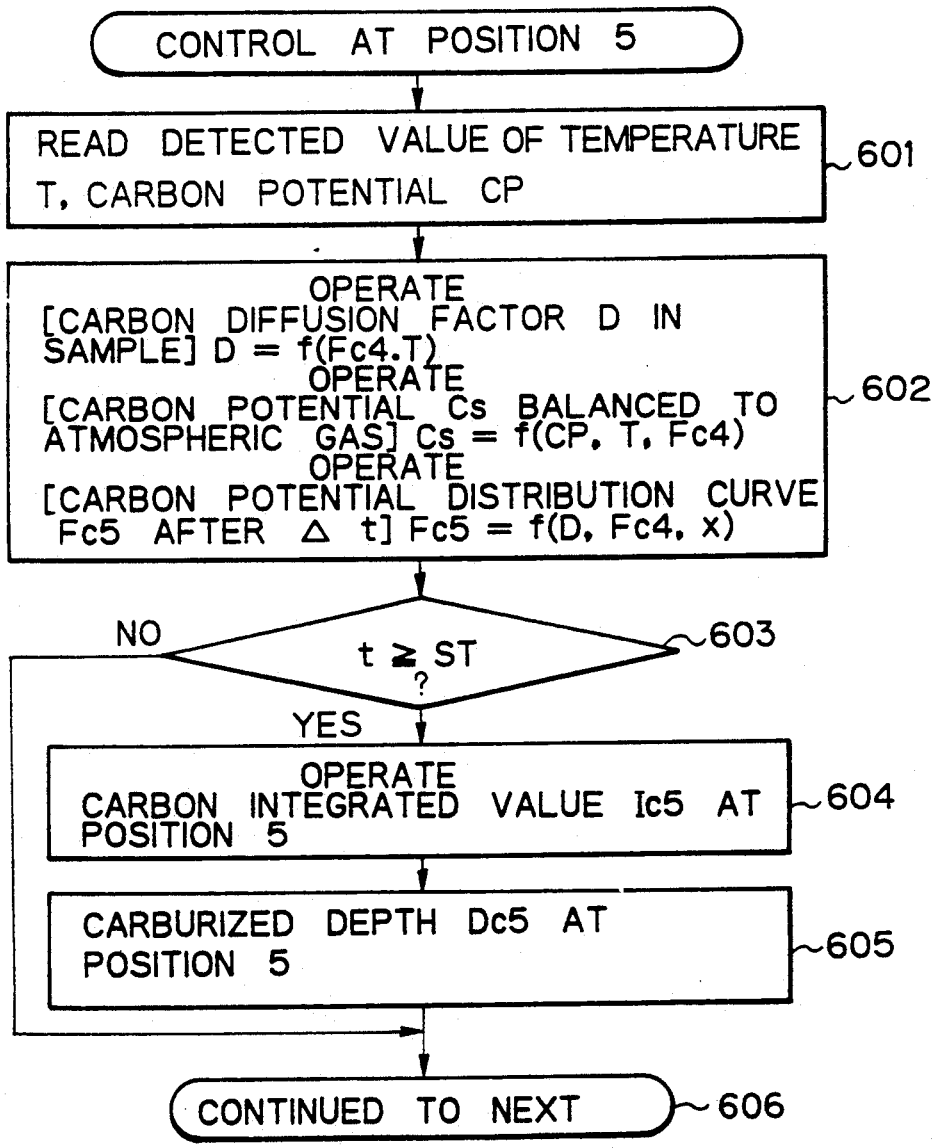
FIG. 9 is a flowchart showing a control of the heater temperature and carbon potential of the first embodiment each at the position 5 in FIG. 8.

FIG. 9 is a flowchart showing an operation of a carbon integrated value Ic5 and a carburized depth Dc5 for a sample at the carburizing position 5 as shown at step 511 of FIG. 5. At step 601, the control executes a read of the detected value of the temperature T and the carbon potential CP each from the sensor S at the carburizing position 5 as shown in FIG. 4, and at the next step 602 a carbon diffusion factor D within the sample is operated as a function of a carbon potential distribution Fc4 and a temperature T each at the carburizing position 4; a carbon potential Cs balanced with atmospheric gas is operated as a function of the carburization potential CP, the temperature T, and the carbon potential distribution Fc4, and further a new carburization potential distribution Fc5 after the time Δt at the carburizing position 5 is operated as a function of the diffusion factor D within the sample, the new carburization potential distribution Fc4, and a distance "x" from the surface of the member to be carburized. The operation formula in this case is established as follows.

$$dC/dt=(d/dx)\times(D\times dc/dx) \quad (1)$$

where $$D\times exp[-0.64-1.58C-]\times exp[1/T\times(0.33\times C-1.88)\times 104] \quad (2)$$

and "t" represents the time.

Since a general solution cannot be obtained from the equation (1), the operation is executed using a difference method at step 602. That is, a distance L is taken from the surface of the sample and divided into "n" equivalent parts to be named sequentially from the surface as column 1, column 2, column "n". Assume that Ci represents a carbon potential of column "i" at the optional time "t", Di a carbon diffusion factor at that carbon potential, and C'i a carbon potential of column "i" before the very small time (Δt), then (N−2) pieces of equations are established as follows: here "i" represents 2 to (N−1).

$$\Delta t/2\Delta x\times(Ci-1-Ci)\times(Di-1+Di)+(Di-1--Di)\times(Di-1+Di)=(Di-C'i)\times\Delta x \quad (3)$$

In column 1, a sum of a carbon volume flowing from column 2 and another carbon volume flowing from the surface contacting atmospheric gas is equal to an increase of the carbon amount at column 1, accordingly, the following equation is satisfied.

$$\Delta t\times(CS-C1)\times K+\Delta t/2\Delta x\times(C2-C1)\times(D2+D1-)=(C1-C'1)\times\Delta x \quad (4)$$

further, in column N, the following equation is established, $$\Delta t/2\Delta x\times(CN-1-CN)\times(DN-1+DN)+4\times(C0--CN)\times DN=(CN-C'N)\times\Delta x \quad (5)$$

since the equations (3) to (5) are N pieces of simultaneous equations related to unknowns C1 to CN, the equations can be solved by providing an initial value of the carbon potential Ci and the required constants. The then required constants include Δx (a distance from the surface of the member), Δt (time), C0 (an original carbon potential of the material), Di (a diffusion factor within the sample, provided by the equation (2)), CS (the carbon potential balanced with atmosphere), and K (a reaction factor). The constants Δx and Δt may preferably be provided very small suitable values, respectively.

The carbon potential CS in the case of a member of SCr420 in accordance with JIS (the Japanese Industrial Standard) is $CS=CP\times 10^{V/W}$ <assume, $V=2300/T-2.24+180C1/T\times\{-(102/T-0.33)--0.85\times 21.8/T+0.25\times[(62.5/T+0.041)+8.9\times C-1/T]\}$, $W=2300/T-2.24+180/T\times CP$, reaction factor $K=21.6\times 10-6$>.

At step 603, it is determined whether or not the cycle time ST lapses. If the cycle time ST does not lapse (NO), the control proceeds to step 606 to terminate this routine. If the cycle time ST is terminated (YES), the control proceeds to step 604 to operate the carbon integrated value Ic5 at the carburizing position 5, and this routine is completed at step 606 after the operation of the carburized depth Dc5 at step 605.

Figure 14:
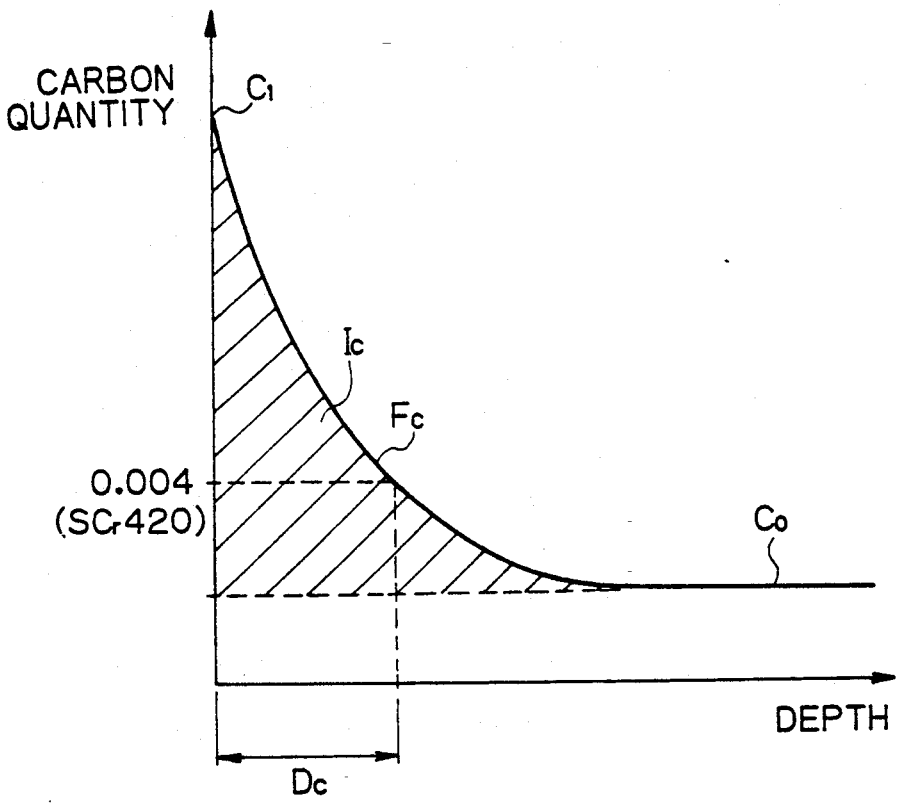
FIG. 14 is a characteristic diagram showing a carbon quantity relative to a depth from the surface of a carburization member.

A carbon potential distribution curve can be produced from the computed value as previously described as shown in FIG. 14. The carburized depth Dc5 at the carburizing position 5 can be obtained from the material depth corresponding to the specified carbon quantity with reference to the carbon potential distribution curve in FIG. 14. More specifically, FIG. 14 shows a relationship between the carburized depth of carburized structural elements (samples) and the carbon amount, where CI represents the carbon potential at the surface of the sample and Fc represents the carbon potential distribution Fc5. According to the curve of the carbon potential distribution Fc5, the increase of the depth from the surface provides an approximation of the carbon amount C0 originally included in the sample.

The area shadowed by oblique lines is shown at the lower curve of the carbon potential distribution Fc5 and is equal to the carbon integrated value Ic5. In the case of JIS SCr420 member as previously described, a depth of material corresponding to the carbon potential of 0.4% is represented by a carburized depth Dc.

Figure 10:
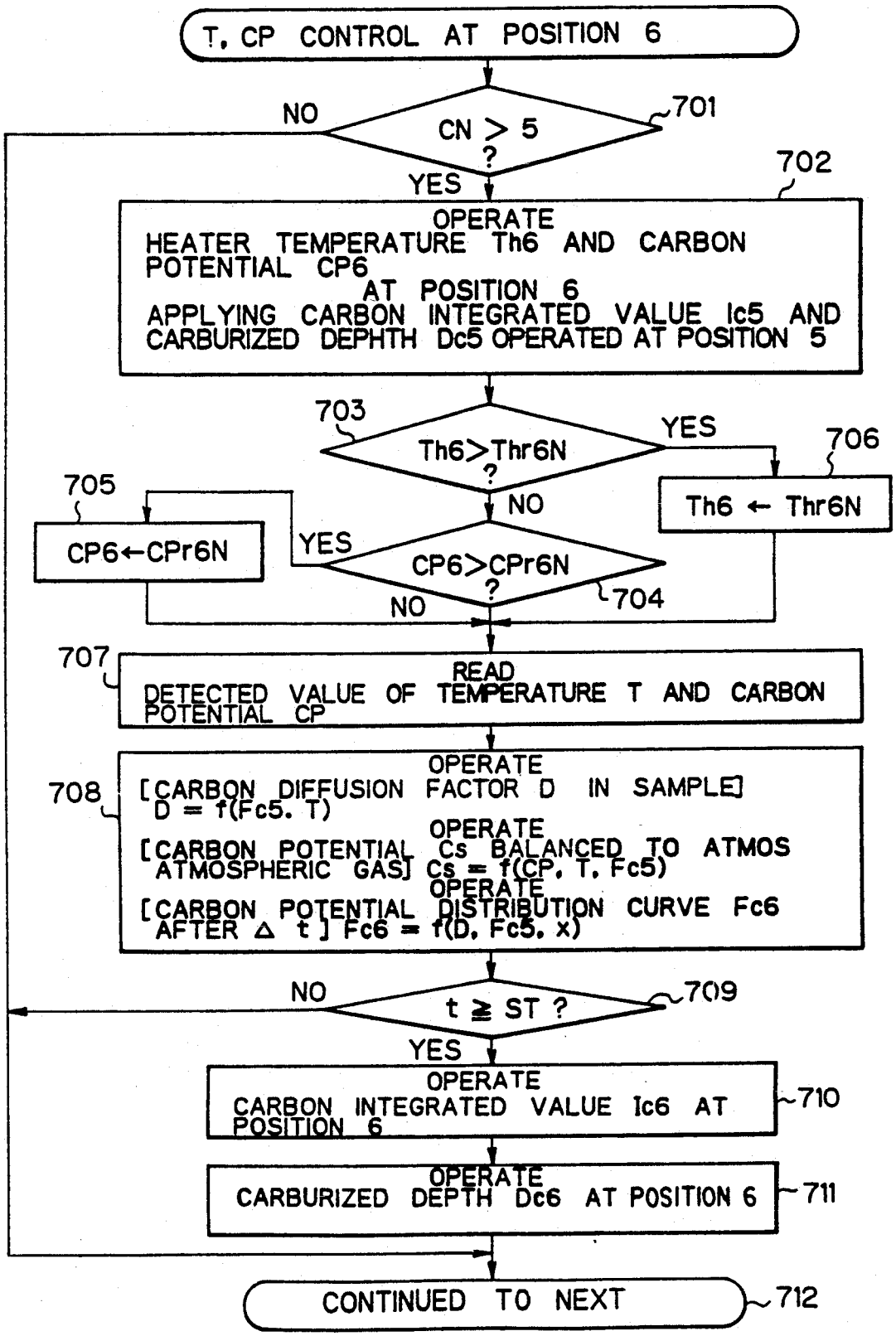
FIG. 10 is a flowchart showing a control of the heater temperature and carbon potential of the first embodiment each at the position 6 in FIG. 8.

FIG. 10 is a flowchart showing a control of the temperature T (°K.) of the sample and the carbon potential CP at a carburizing position 6 as shown at step 512 of FIG. 8. At step 701, it is determined whether or not a value of the counter CN exceeds 5, and if it does not exceed 5, the control proceeds to step 712 to complete this routine, but only in the case that it exceeds 6, this routine is executed, because the conventional control is executed during the time when CN is ranging from 1 and 4 and if CN is 5 the tray at the position 6 is vacant as shown in FIG. 6. When CN exceeds 6, a heater temperature TH6 and a carbon potential CP6 each at the position 6 are operated at step 702. This operation is executed based on the carbon integrated value Ic5 and the carburized depth Dc5 each computed at the position 5 when CN is equal to 5, a carbon integrated reference value Icr5N and a carburized depth reference value Dcr5N each at the carburizing position 5 of the member, and a heater temperature reference value THr6N and a carbon potential reference value CPr6N each at the position 6 to which the member is next sent. Namely, the operation is executed based on the following equation, $$\begin{pmatrix} Th6 \\ Cp6 \end{pmatrix} = \begin{pmatrix} a_{11} & a_{12} & a_{13} & a_{14} & a_{15} & a_{16} \\ a_{21} & a_{22} & a_{23} & a_{24} & a_{25} & a_{26} \end{pmatrix} \begin{pmatrix} Dc5 \\ Ic5 \\ Dcr5N \\ Icr5N \\ Thr6 \\ Cpr6 \end{pmatrix}$$

At steps 703 to 706, the heater temperature TH6 and the carbon potential CP6 each computed at the position 6 are guarded to prevent from exceeding the heater temperature reference value THr6N and the carbon potential reference value CPr6N of each of the members at the position 6. At step 707, the detected value of the temperature T and the carbon potential CP from the sensor S at the carburizing position 6 as shown in FIG. 4 are read, and at step 708 the diffusion factor D of carbon within the sample is operated as a function of the carbon potential distribution Fc5 and the temperature T of the samples up to the carburizing position 5, and the carbon potential Cs balanced with atmospheric gas is operated as a function of the carbon potential CP, the temperature T, and the foregoing carbon potential distribution Fc5, and further the carbon potential distribution Fc6 after the time Δt is operated as a function of the diffusion factor D within the sample, the foregoing carbon potential distribution Fc5, and the distance "x" from the surface of the carburization processed member. The operating equations have been described and accordingly will be omitted hereinafter. At step 709, it is determined whether or not the cycle time ST lapses. If the cycle time ST does not lapse (NO), the control proceeds to step 712 to terminate this routine, and if the cycle time ST terminates (YES), the control proceeds to step 710 to operate the carbon integrated value Ic6 at the carburizing position 6, and at step 711 the carburized depth Dc6 is operated. The operation of the carburized depth Dc6 at the carburizing position 6 is the same as at the carburizing position 5, and will also be omitted hereinafter. Thereafter, this routine is completed at step 712.

Figure 11:
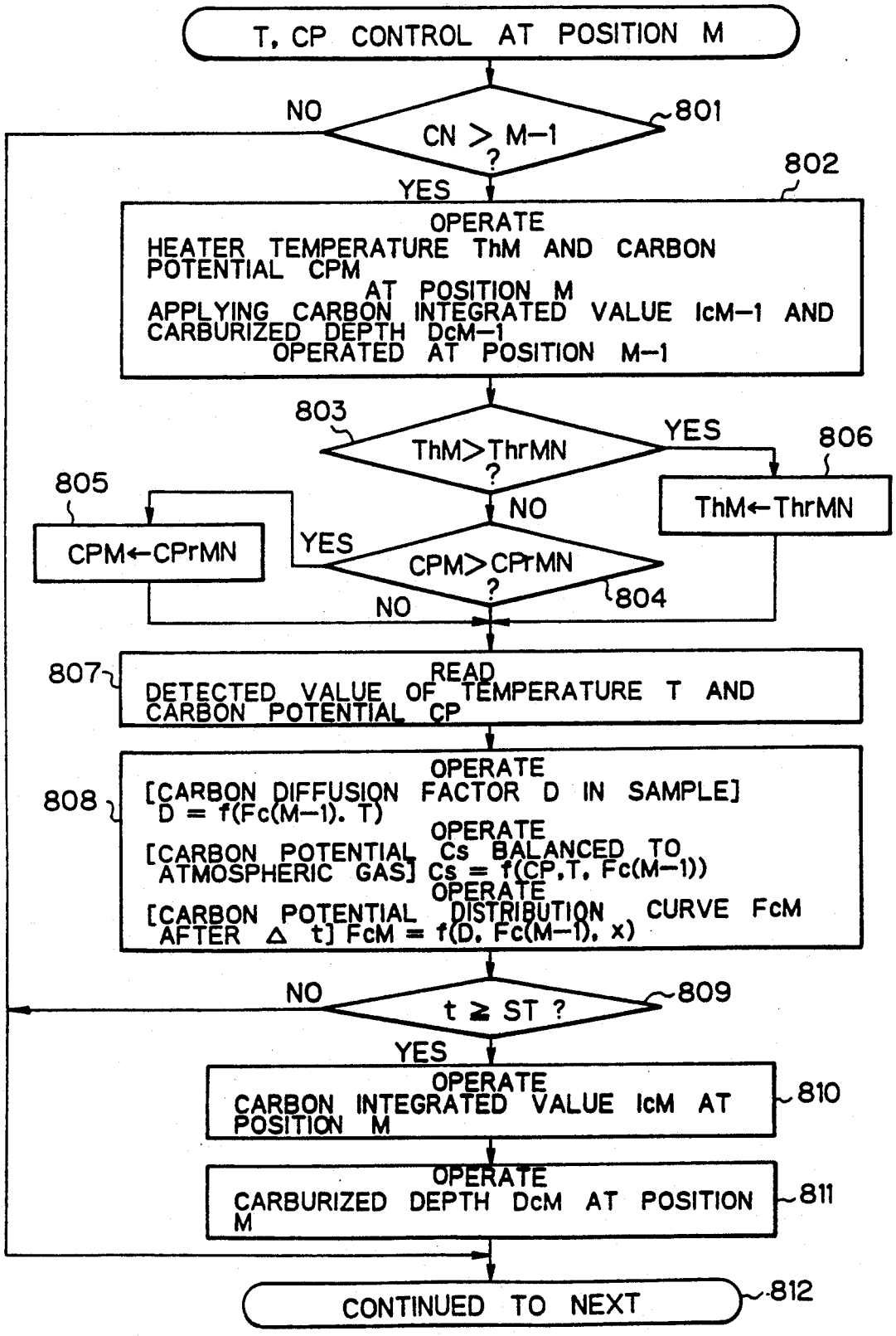
FIG. 11 is a flowchart showing a control of the heater temperature and carbon potential of the first embodiment each at the positions 7 to 12 in FIG. 8.

FIG. 11 is a flowchart showing a control of the temperature T (°K.) and the carbon potential CP of each sample at the carburizing positions 7 to 12 as shown at steps 513 to 518 of FIG. 8. However, the control of the temperature T and the carbon potential CP of each sample at the carburizing positions 7 to 12 is the same as the control procedure at the carburizing position 6, accordingly, the explanation therefor will be omitted hereinafter.

Figure 12:
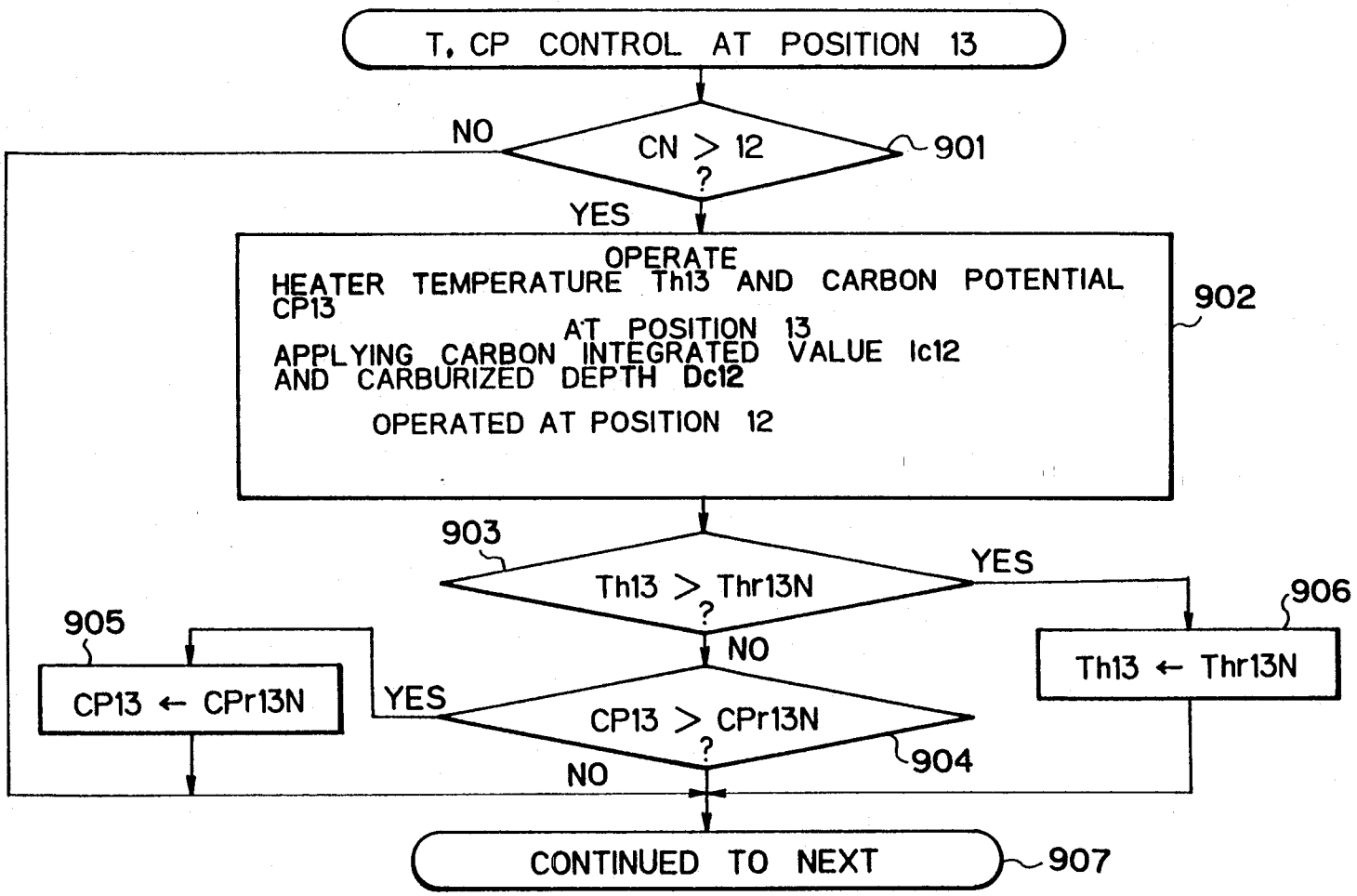
FIG. 12 is a flowchart showing a control of the heater temperature and carbon potential of the first embodiment each at the position 13 in FIG. 8.

FIG. 12 is a flowchart showing a control of the temperature T (°K.) and the carbon potential CP of each sample at the carburizing positions 13 as shown at step 519 of FIG. 8. Since the carburizing position 13 is positioned at the last position of the diffusion zone, it is not required to operate the temperature T and the carbon potential CP of each sample at the next position. In this connection, the control at the carburizing position 13 does not only include control at steps 807 to 811 compared to FIG. 11, and therefore is substantially equivalent to the flowchart shown in FIG. 11. The explanation therefor will be omitted hereinafter.

Figure 13:
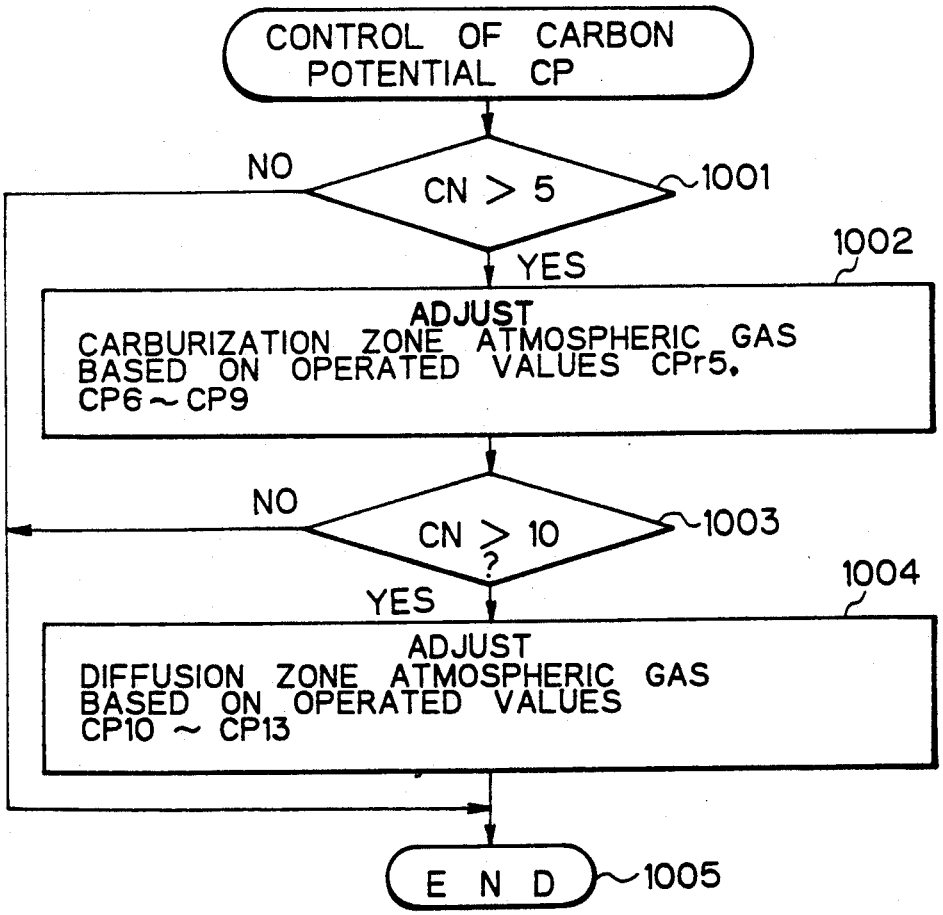
FIG. 13 is a flowchart showing a control of the carbon potential of the first embodiment.

FIG. 13 is a flowchart showing a control of the carbon potential CP of the carburization furnace shown in FIG. 4. The carbon potential CP is operated at each position of the carburizing positions 5 to 13, however in this embodiment as shown in FIG. 4, an atmospheric gas potential within the temperature rising zone, the carburization zone, and the diffusion zone are not changed at every carburizing position, and are of the same value within each zone. In the control of FIG. 13, at step 1001 it is determined whether or not the counter CN exceeds 5, and when CN is equal to from 1 to 5, an adjustment of atmospheric gas at the carburization zone is not performed, and when CN is equal to or more than 6, at step 1002 the adjustment of the gas potential by an atmospheric gas control device G2 is performed in consideration of an overall operation based on computed values CPr, CP6 to CP9 of the atmospheric gas potential at the carburizing positions 5 to 9. At step 1003, it is determined whether or not the counter CN exceeds 10, and when CN is equal to from 1 to 10, no adjustment is performed for the atmospheric gas of the carburization zone. When CN is equal to or more than 11, the gas potential adjustment is executed by the atmospheric gas control device G3 in consideration of the overall operation based on the atmospheric gas potential computed values of CP10 to CP13 at the carburizing positions 10 to 13 at step 1004.

In this way, by applying the method according to the present invention to the continuous carburization furnace in FIG. 4, when the member to be processed is changed to cause a variation of the condition of each zone, the carburizing condition of the carburization furnace can be continuously and gradually varied only by sending out the minimized number of vacant trays, and therefore productivity in the carburization can be improved even at the time of exchanging the stage without stagnation of the carburizing process.

(2) The case that the historical control is always performed on the member to be carburized.

The control in this case including a control at the time of changing the carburizing condition is to execute a continuous operation always observing the carburization history of the carburization processed member; the control thereof will be described with reference to flowcharts in FIGS. 15A to 20.

Figure 15A:
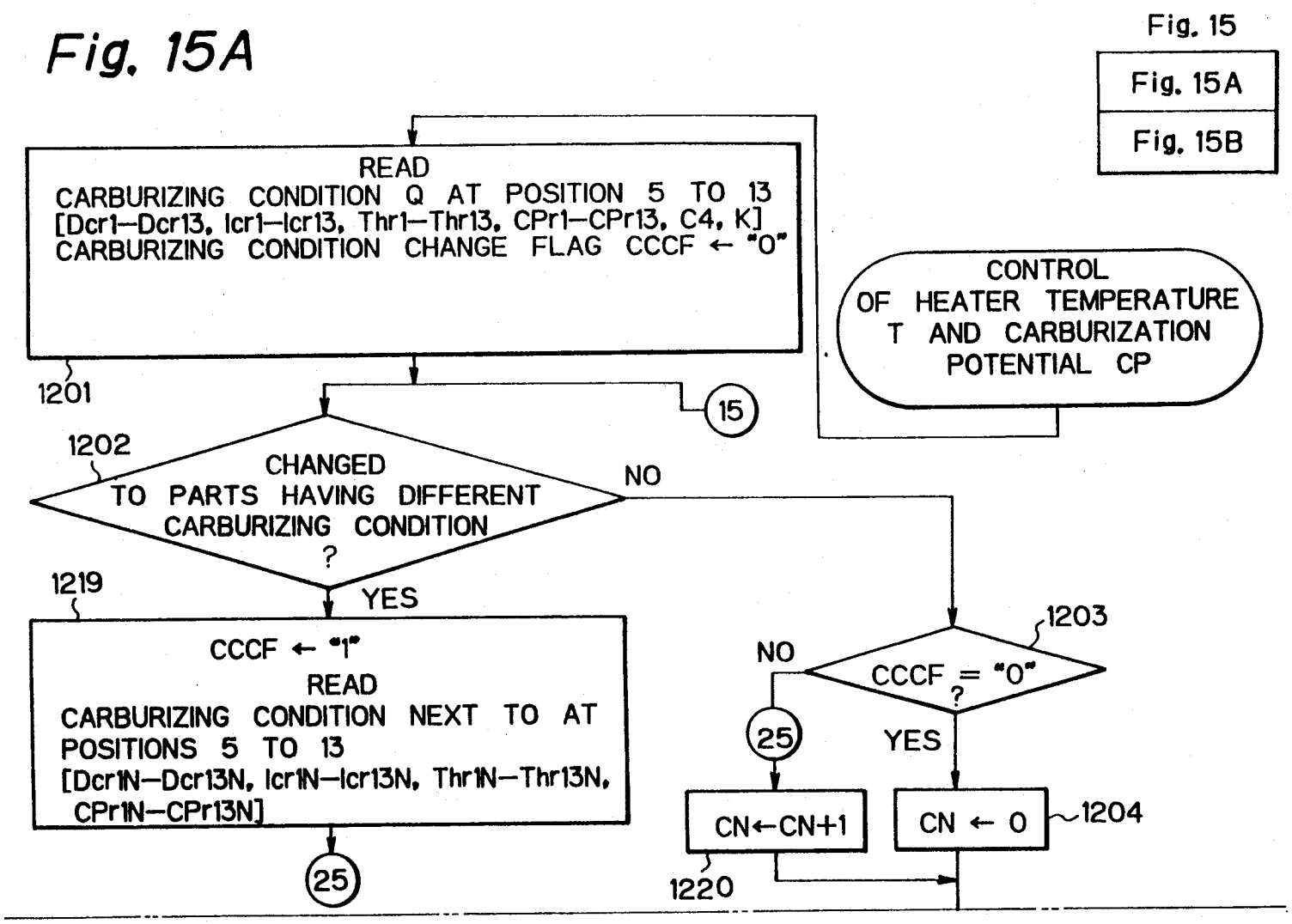
FIGS. 15A and 15B are flowcharts showing a control of a heater temperature and a carbon potential of a second embodiment.
Figure 15B:
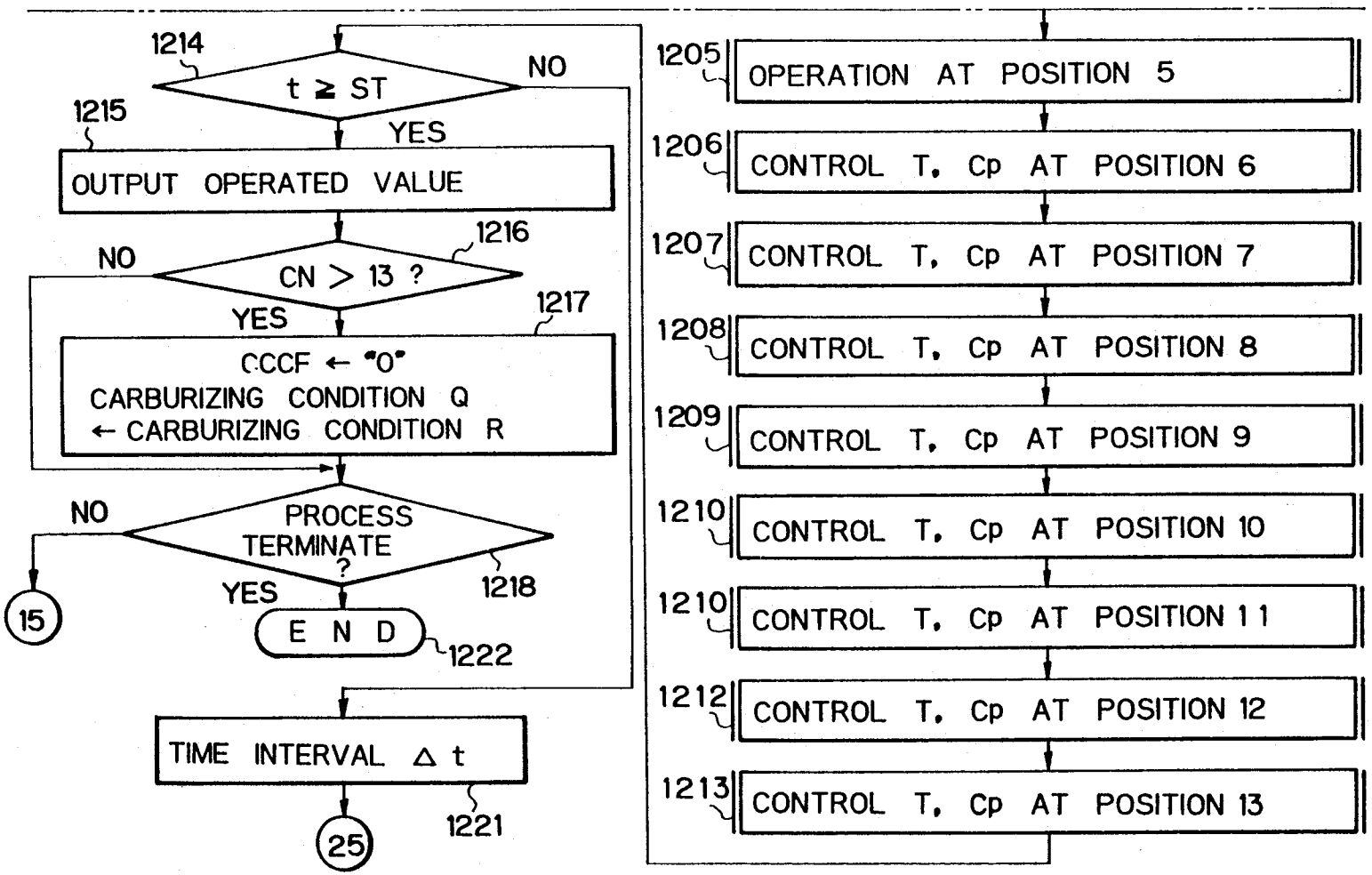

FIGS. 15A and 15B are flowcharts showing a control of the temperature T and the carbon potential CP. At step 1201, the control provides a read of the carburizing condition Q at the carburizing positions 1 to 13 and concurrently provides a value "0" to the carburizing condition change flag CCCF. This carburizing condition Q includes the carburized depth reference values Dcr1 to Dcr13 of the carburization processed member, the carbon integrated reference values Icr1 to Icr13, the heater temperature reference values Thr1 to Thr13, the carbon potential reference values CPr1 to CPr13, the carbon potential distribution Fc4 of the material up to the carburizing position 4, and the reaction factor K. At step 1202 it is determined whether or not the member is changed to one having the different carburizing condition.

The present invention will be described for the case that the carburizing condition is not changed. If the carburizing condition is not changed, the control proceeds to step 1203, where the carburizing condition change flag CCCF is "0", then at step 1204 the control clears the value of counter CN to proceed from step 1205 to step 1213. Here, the heater temperature T and the carbon potential CP at the carburizing positions 5 to 13 are controlled, which will be described in detail with respect to each position. After the processes at steps 1205 to 1213, it is determined whether or not the cycle time ST lapses at step 1214. If the cycle time ST does not lapse, the control returns to step 1205 after the time interval Δt at step 1221 to repeat the processing of steps from 1205 to 1213, and if the cycle time ST lapses, the values operated at steps from 1205 to 1213 are output at step 1215, and at step 1216 it is determined whether or not the value of the counter CN exceeds 13. This decision must be made when the carburization processed member is changed, and if the member is not changed, the control proceeds to step 1218 because the value CN is made equal to "0" at step 1204. At step 1218 it is determined whether or not the carburization process is all terminated (the operation is terminated), and if the processes are terminated, this routine is completed at step 1222, but if not terminated, the routine returns to step 1202 to repeat the processes.

In the case that the member is changed into one having a different carburizing condition, the control proceeds from step 1202 to step 1219 to read the carburizing condition of the next member to be carburized having the different carburizing condition at the carburizing positions 5 to 13, concurrently makes the carburizing condition change flag CCCF "1". This carburizing condition includes the carburized depth reference values Dcr1N to Dcr13N of the next member, the carbon integrated reference values Icr1N to Icr13N, the heater temperature reference values Thr1N to Thr13N, and the carbon potential reference values CPr1N to CPr13N. At step 1220 the control increments the counter CN value by "1" to proceed to step 1205 and thereafter to execute the processing of steps from 1205 to 1213 as previously described. When the member is changed into one having a different cycle time, the cycle time is changed by a procedure of the flowchart shown in FIG. 7.

When the member is changed into one having a different carburizing condition, after such a change of the member the control proceeds from step 1216 to step 1218 until the CN value exceeds 13. If the CN value exceeds 13, namely, the furnace is filled therein with the new member to be carburized, then the control proceeds from step 1216 to step 1217 to make the carburizing condition change flag CCCF "1", concurrently the carburizing condition Q is replaced by the new carburizing condition R. As a result, thereafter the control determines YES at step 1203 to proceed to step 1204, where the same control is executed as the member is not changed into one having the different carburizing condition.

Figure 16:
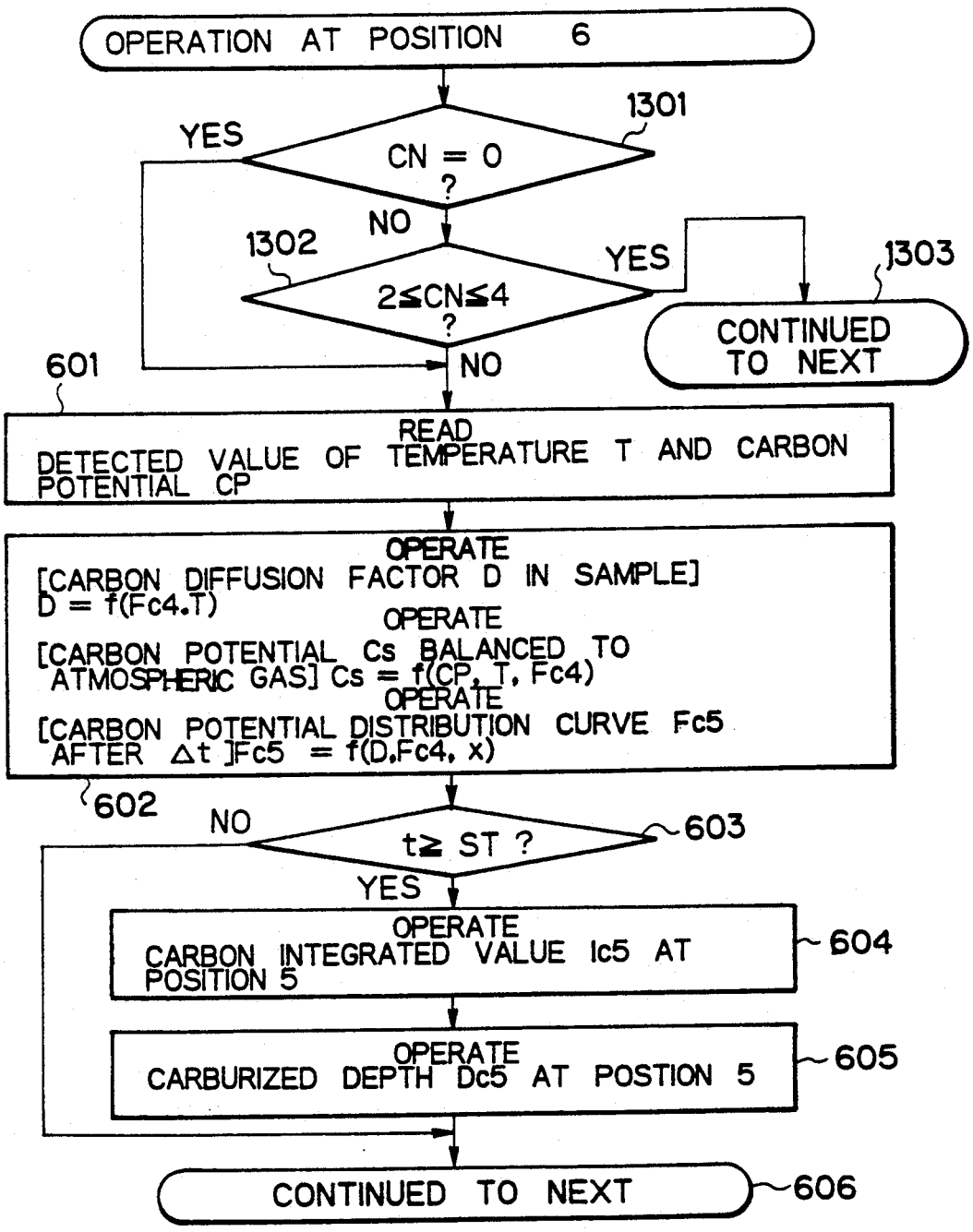
FIG. 16 is a flowchart showing a control of the heater temperature and carbon potential of the second embodiment each at the position 5 in FIG. 8.

FIG. 16 is a flowchart showing an operation of the carbon integrated value Ic5 and the carburized depth Dc5 of each of the samples at the carburizing position 5 as shown at step 1205 in FIG. 15. In this operation, most of the controls are common with those as shown in FIG. 9, accordingly identical step numbers used in connection with FIG. 9 indicate commonly constituent elements, and thus repetition of an explanation thereof will be omitted. Points of the control in FIG. 16 different from those in FIG. 9 are only steps 1301 and 1302. When the historical control is always performed, the control is executed at steps 601 to 606, but the control is not performed only when the vacant trays are passing after the member has been changed into one having a different carburizing condition. Thus, at the position 5 as shown in FIG. 6 the vacant tray passes when the counter CN value is ranging from 2 to 4, so the control determines this at step 1302 and proceeds to step 1303 to prevent the processing of steps 601 to 606 during the passing of the trays.

Figure 17A:
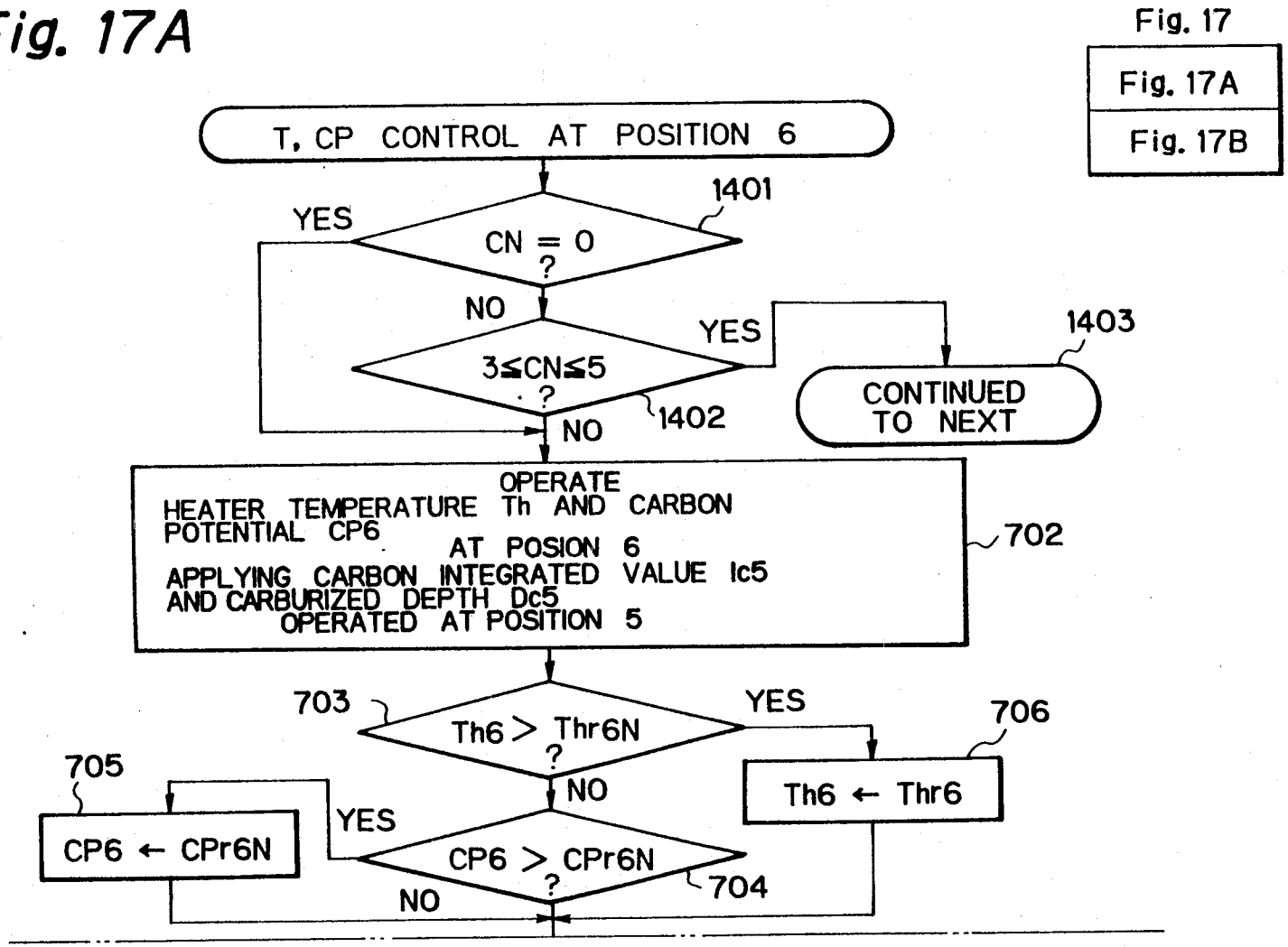
FIGS. 17A and 17B are flowcharts showing a control of the heater temperature and carbon potential of the second embodiment each at the position 6 in FIG. 8.
Figure 17B:
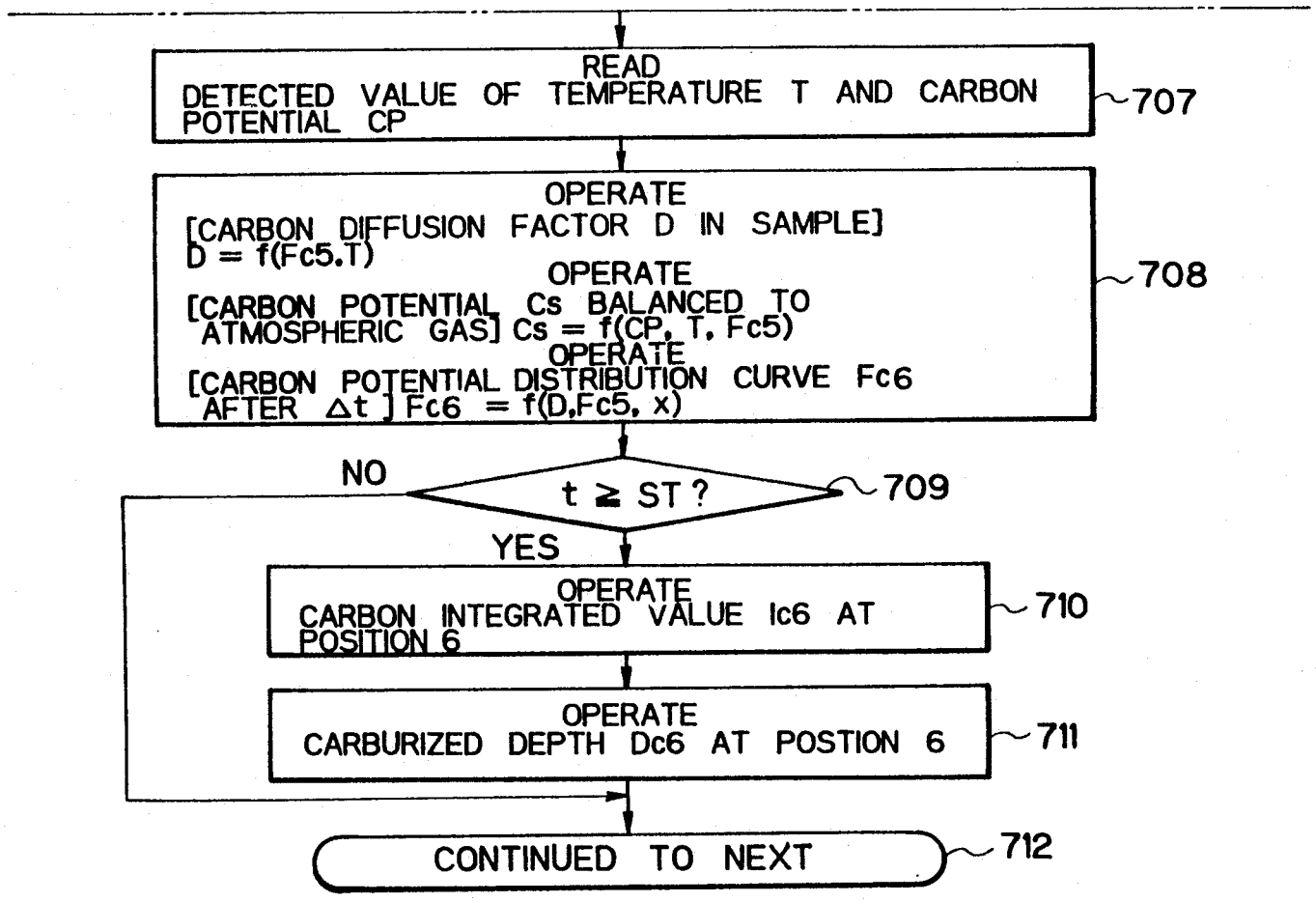

FIGS. 17A and 17B are flowcharts showing a control of the temperature T and the carbon potential CP of each the sample at the carburizing position 6 as shown at step 1206 in FIG. 15. In this operation, most of the controls are common to those as shown in FIG. 10, accordingly identical step numbers used in connection with FIG. 10 indicate commonly constituent elements, and thus repetition of an explanation thereof will be omitted. Points of the control in FIGS. 17A and 17B different from those in FIG. 10 are only steps 1401 and 1402. When the historical control is always performed, the control is executed at steps 702 to 712, but the control is not performed only when the vacant trays are passing after the member has been changed into one having a different carburizing condition. Thus, at the position 6 as shown in FIG. 6 the vacant tray passes when the counter CN value is ranging from 3 to 5, so the control determines this fact at step 1402 and proceeds to step 1403 to prevent the processing of steps 702 to 712 during the passing of the trays.

Figures 18, 18A, 18B:
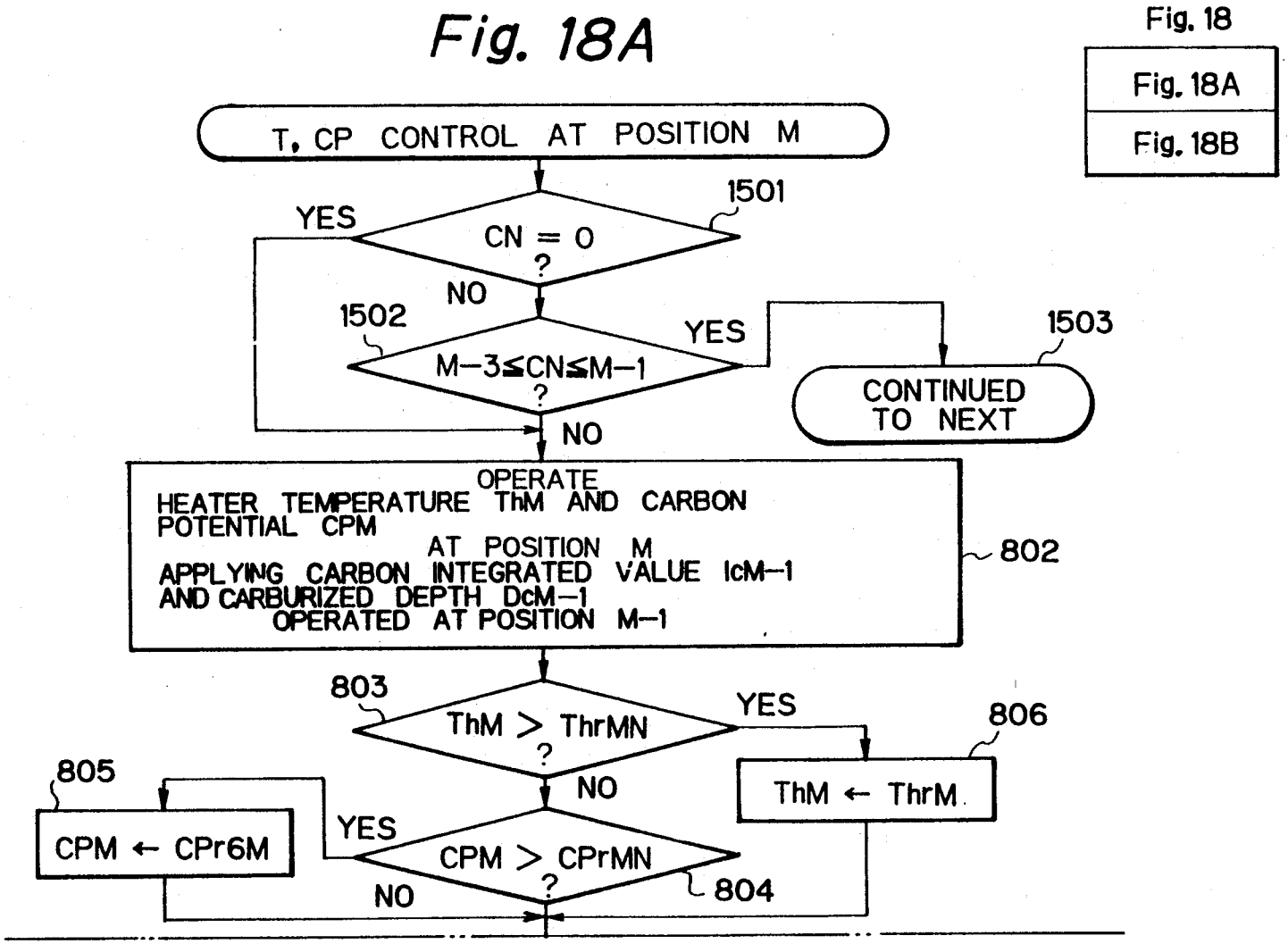
FIGS. 18A and 18B are flowcharts showing a control of the heater temperature and carbon potential of the second embodiment each at the positions 7 to 12 in FIG. 8.
Figure 18B:
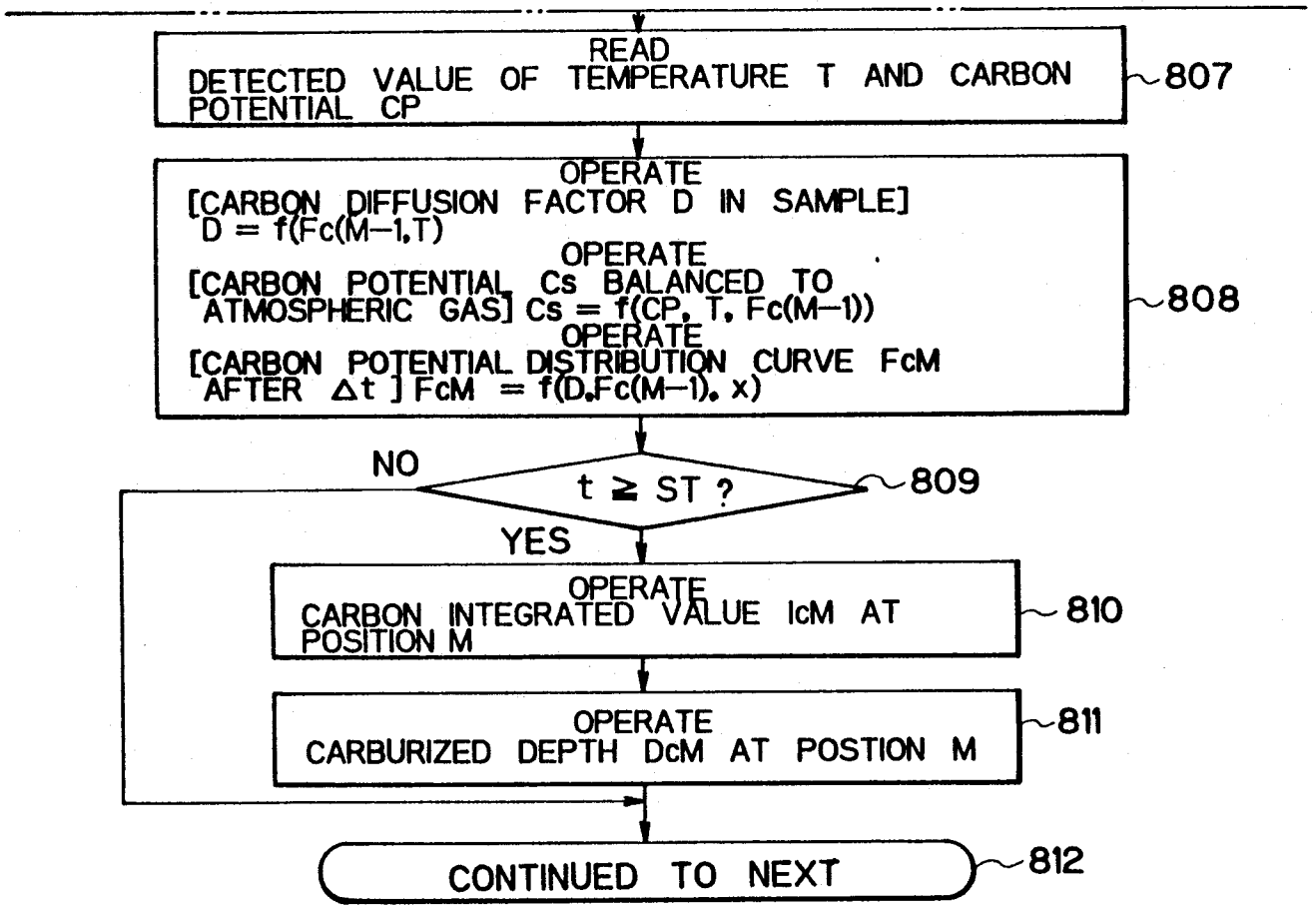

FIGS. 18A and 18B are flowcharts showing a control of the temperature T and the carbon potential CP of each sample at the carburizing positions 7 to 12 as shown at steps 1207 to 1212 in FIG. 15. In this operation, most of the controls are common to those as shown in FIG. 11, accordingly identical step numbers used in connection with FIG. 11 indicate commonly constituent elements, and thus repetition of an explanation thereof will be omitted. Points of the control in FIGS. 18A and 18B different from those in FIG. 11 are only steps 1501 and 1502. When the historical control is always executed, the control is executed at steps 802 to 812, but the control is not performed only when the vacant trays are passing after the member has been changed into one having a different carburizing condition. Thus, at the position M as shown in FIG. 6 the vacant tray passes when the counter CN value is ranging from M−3 to M−1, so the control determines this at step 1502 and proceeds to step 1503 to prevent the processing of steps 802 to 812 during the passing of the trays.

Figure 19:
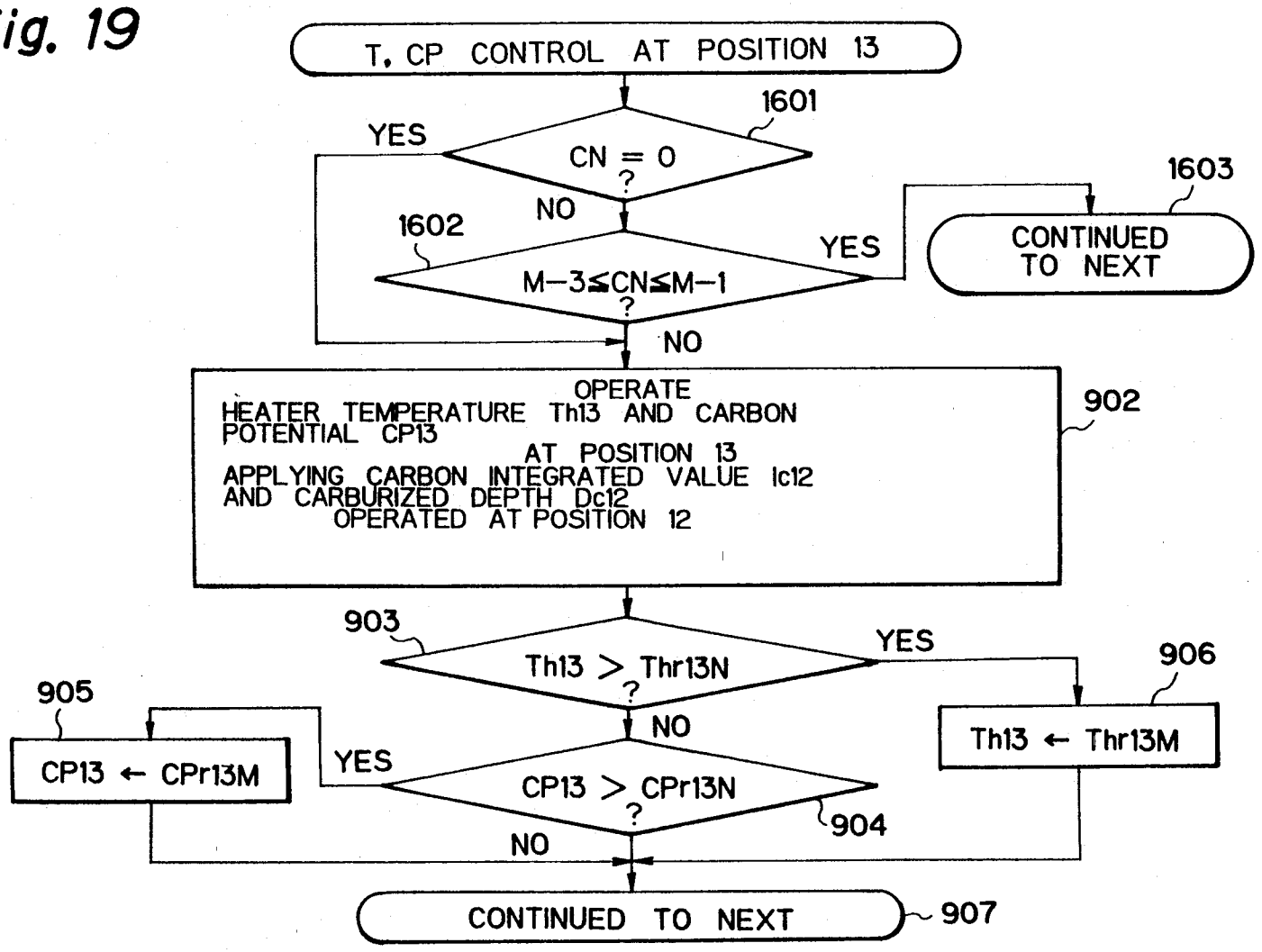
FIG. 19 is a flowchart showing a control of the heater temperature and carbon potential of the second embodiment each at the position 13 in FIG. 8.

FIG. 19 is a flowchart showing a control of the temperature T and the carbon potential CP of each sample at the carburizing position 13 as shown at step 1213 in FIG. 15. In this operation, most of the controls are common to those as shown in FIG. 12, accordingly identical step numbers used in connection with FIG. 12 indicate commonly constituent elements, and thus repetition of an explanation thereof will be omitted. Points of the control in FIG. 19 different from those of FIG. 12 are only steps 1601 and 1602. When the historical control is always executed, the control is executed by all means at steps 902 to 907, but the control is not performed only at the time when the vacant trays are passing after the member has been changed into one having a different carburizing condition. Thus, at the position 13 as shown in FIG. 6 the vacant tray passes when the counter CN value is ranging from 10 to 12, so the control determines this at step 1602 and proceeds to step 1603 to prevent the processing of steps 902 to 907 during the passing of the trays.

Figure 20:
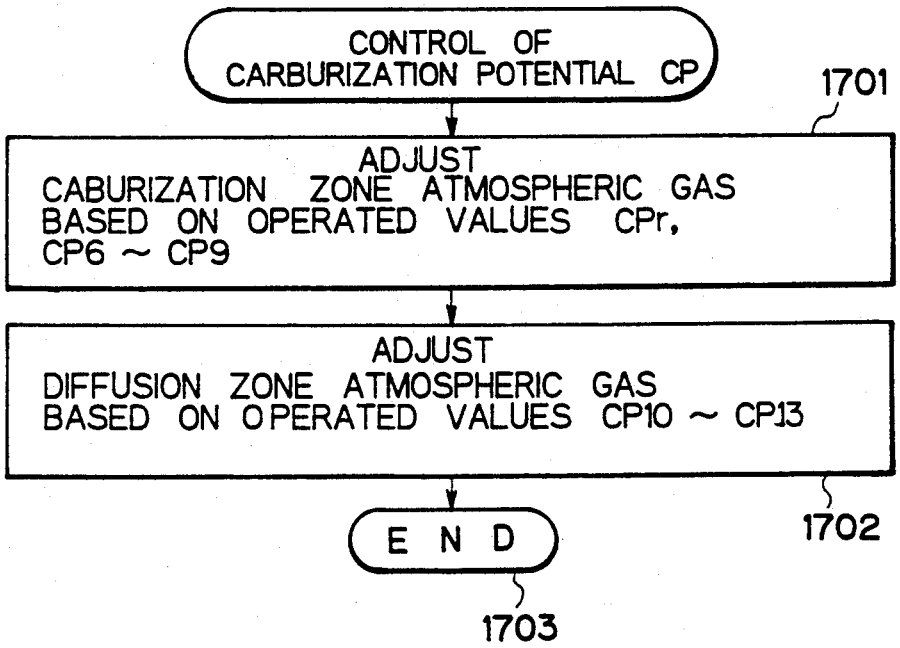
FIG. 20 is a flowchart showing a control of the carbon potential of the second embodiment.

FIG. 20 is a flowchart showing a control of the carbon potential CP of the present embodiment. The carbon potential CP is operated at each of the carburizing positions 5 to 13. Similarly, in this embodiment as shown in FIG. 4, the atmospheric gas potential within the temperature rising zone, the carburization zone, and the diffusion zone cannot be changed at every carburizing position, this thus means that the atmospheric gas potentials are individually the same within each zone. At step 1701, a gas potential is then adjusted by the atmospheric gas control device G2 in consideration of an overall operation based on the atmospheric gas potential operated values CPr5, CP6 to CP9 at the carburizing positions 5 to 9, and at step 1702 a gas potential is adjusted by the atmospheric gas control device G3 in consideration of an overall operation based on the atmospheric gas potential operated values CP10 to CP13 at the carburizing positions 10 to 13.

In the case that the method according to the present invention is applied to the continuous carburization furnace in FIG. 4, the carburization control is executed based on the temperature and atmospheric conditional information received by the members on each tray, therefore a fluctuation of the carburized depth does not generate even during the change of the operational condition. Even when the member to be processed is changed, the carburizing condition of the carburization furnace can be continuously and gradually changed only by sending the minimized number of vacant trays; accordingly productivity in the carburization can be improved without stagnation of the carburization process even in exchanging the stage.

Figure 21:
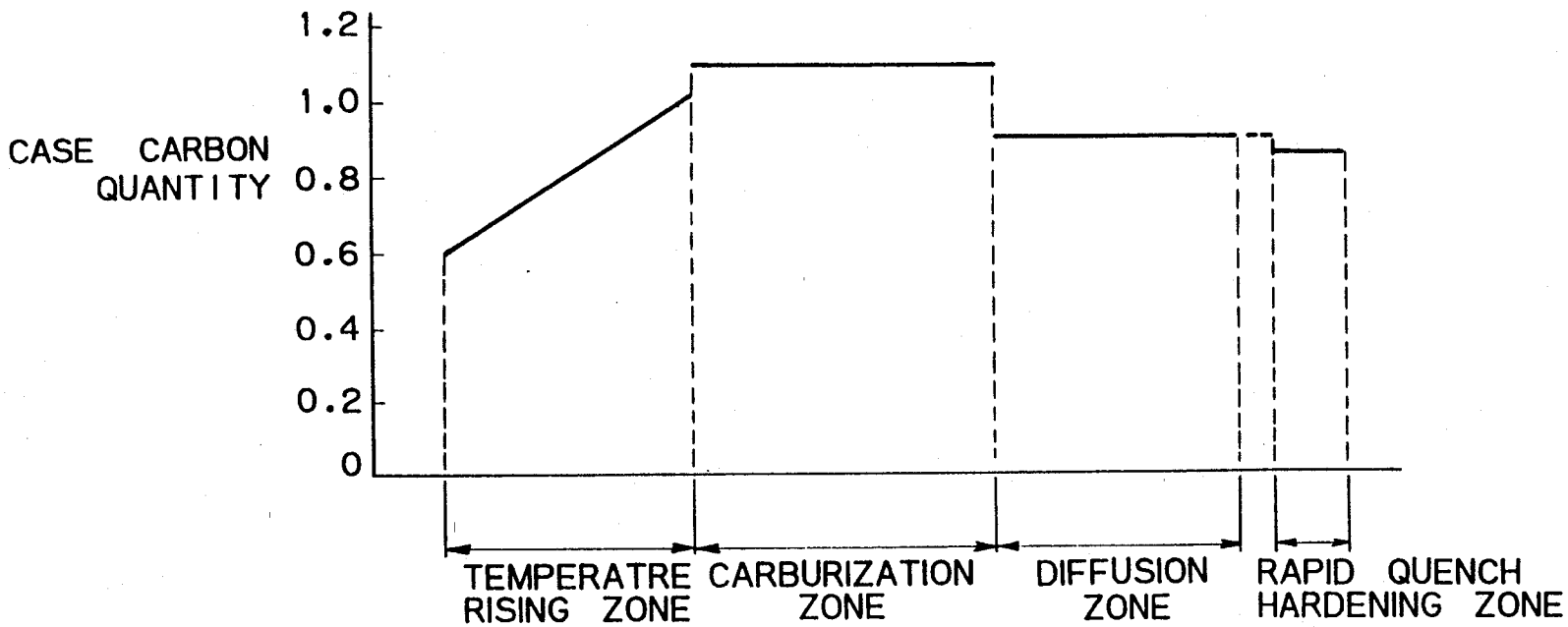
FIG. 21 is a characteristic diagram showing a surface carbon distribution of the member to be carburized at each zone according to a method of controlling the carburization furnace in accordance with the present invention.
Figure 22:
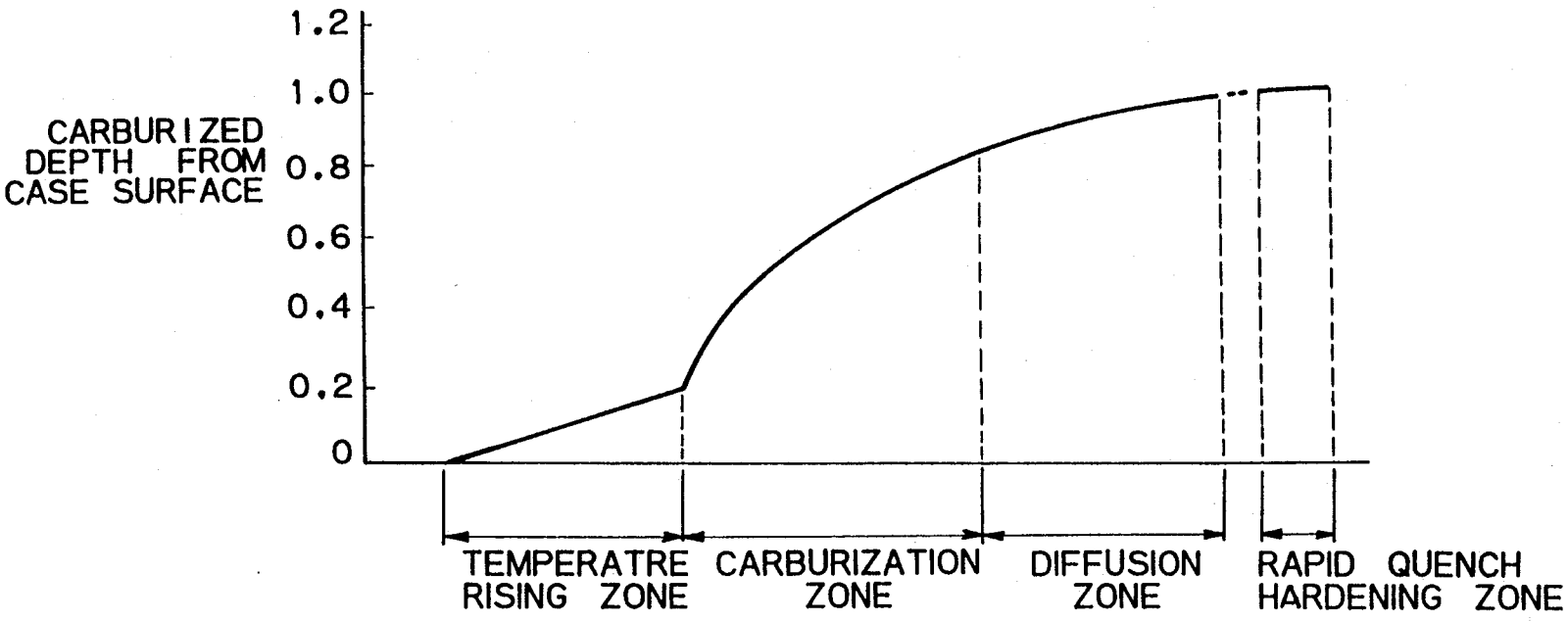
FIG. 22 is a example showing a carburized depth (distance) of the member to be carburized at each zone according to a method of controlling the carburization furnace in accordance with the present invention.

FIGS. 21 and 22 are examples of the distribution of the surface carbon quantity and the carburized depth (distance) of each of the carburized member at each zone when the continuous carburization furnace is controlled by a method controlling the carburization furnace according to the present invention.

As hereinbefore described according to the present invention, the condition during operation at the next target position of the feeding is controlled by means of simulation and comparison with the reference value that provides a clear carburization state of the member on each tray; thereby the carburization processed member can exhibit a minimized fluctuation of the carburized depth. The control can always be performed with an estimation of the fluctuations of the components or the material quality that disadvantageously affects the quench hardening depth. Further, the control can also be made with an estimation of the increased depth of the carburization hardening for the thinner member. In addition, unlike the conventional furnace, according to the present invention the employment of the test pieces for a measurement of the carburized depth at every tray and a measurement of the carburized depth of the test pieces is not required, therefore the member to be carburized can be produced at a high productivity rate without waste.

In the embodiment as hereinbefore described, the heater temperature Th6 and the carbon potential Cp6 are each operated at the position 6 based on the operated value obtained by operating the carbon integrated value Ic5 and the carburized depth Dc5 of each sample at the position 5, and the heater temperature Th5 and the carbon potential CP5 at the position 5 are not changed even when the carburizing condition is varied. However, if the carburizing condition is changed, the atmospheric gas carbon potential CP5 and the heater temperature Th5 at the carburizing position 5 may preferably be adjusted depending on the difference such that the carbon integrated value Ic5 and the carburized depth Dc5 each operated at steps 604 and 605 are compared with the carbon integrated reference value Icr5N and the carburized depth reference value Dcr5N at the carburizing position 5 of the next member. This adjustment can be performed in the same manner as the operation for the heater temperature Th6 and the carbon potential CP6 at the position 6 based on the operated value at position 5. But, the operation can also be made in a simple manner as follows.

The atmospheric gas carbon potential CP5 and the temperature Th5 at the carburizing position 5 may preferably be adjusted depending on four cases designated in the following table, which is obtained by the difference between the carbon integrated value Ic5 and the carburized depth Dc5 operated at steps 604 and 605 and the carbon integrated reference value Icr5N and the carburized depth reference value Dcr5N at the carburizing position 5 of the next member.

| Case | Ic5 State | Dc5 State | CP5 | Th5 |
|---|---|---|---|---|
| 1 | high | deep | reduce | reduce |
| 2 | high | shallow | slightly reduce | raise |
| 3 | low | deep | slightly raise | reduce |
| 4 | low | shallow | raise | raise |

As hereinbefore fully described, according to the present invention, by way of changing the condition during operation at each zone based on the history of the carburization factor that is obtained at each carburizing position and operated based on the temperature and atmosphere at which the member to be carburized on each tray is exposed at each carburizing position, thus the productivity rate of the carburization can be greatly improved without fluctuation of the carburizing condition irrespective of stagnation of the carburization processing even when exchanging the stage.

What is claimed is:

1. A method of controlling a continuous carburization furnace for carburizing a member to be carburized on a tray that moves in the carburization furnace intermittently, the carburization furnace comprising a temperature rise processing section, a carburization processing section, a rapid quench treatment section, and a quench hardening treatment section, wherein the temperature of the heaters of at least the carburization processing section and the diffusion processing section can be controlled individually at every stop position of the tray, and a few vacant trays are inserted into the furnace when the carburizing condition is changed, comprising the steps of:

reading carburization reference data at each carburization processing position of the carburization processed member;

determining whether or not the carburizing condition is changed;

executing the control for maintaining the temperature and the carbon potential at a constant value at every processing section basis when the carburizing condition is not changed;

reading carburization reference data at each carburization processing position of the carburization processed member having a different carburizing condition to be processed next when the carburizing condition is changed;

detecting a temperature and a carbon potential at each position within a furnace at least during carburization and diffusion processes;

operating a carburized quantity of the carburization processed member at each position with reference to the detected temperature and carbon potential;

operating a carburization history of the carburization processed member by integrating the carburized quantity at each position of the carburization processed member; and determining a carburizing condition at a next carburization processing position depending on a difference between the carburization history at the time of terminating the carburization process at each position of the carburization processed member and the carburization reference data at said each position.

2. A method of controlling a continuous carburization furnace as set forth in claim 1, wherein the detecting step of the temperature and the carbon potential, the operating step of the carburized quantity of the carburization processed member, the operating step of the carburization history of the carburization processed member, and the determining step of the carburizing condition at the next carburization processing position are not executed when the vacant tray is at the carburizing position after the carburizing condition is changed.

3. A method of controlling a continuous carburization furnace as set forth in claim 1, further comprising the step of guarding the determined value of the carburizing condition at the next carburization processing position.

4. A method of controlling a continuous carburization furnace as set forth in claim 3, wherein the detecting step of the temperature and the carbon potential, the operating step of the carburized quantity of the carburization processed member, the operating step of the carburization history of the carburization processed member, the determining step of the carburizing condition at the next carburization processing position, and the guarding step of the determined value of the carburizing condition at the next carburization processing position are not executed when the vacant tray is at the carburizing position after the carburizing condition is changed.

5. A method of controlling a continuous carburization furnace as set forth in claim 1, wherein the heater temperature and the carbon potential at the first position of the carburization processing section are not changed even when the carburizing condition is varied.

6. A method of controlling a continuous carburization furnace as set forth in claim 1, wherein the heater temperature and the carbon potential at the first position of the carburization processing section are adjusted depending on the difference between the carbon integrated value and the carburized depth each operated at the first position of the carburization processing section and the carbon integrated reference value and the carburized depth reference value at the same position of the next member when the carburizing condition is varied.

7. A method of controlling a continuous carburization furnace for carburizing a member to be carburized on a tray that moves in the carburization furnace intermittently; the carburization furnace comprising a temperature rise processing section, a carburization processing section, a rapid quench treatment section, and a quench hardening treatment section, wherein the temperature of the heaters of at least the carburization processing section and the diffusion processing section can be controlled individually at every stop position of the tray, and a few vacant trays are inserted into the furnace when the carburizing condition is changed, comprising the steps of:

reading carburization reference data at each carburization processing position of the carburization processed member;

determining whether or not the carburizing condition is changed;

reading carburization reference data at each carburization processing position of the carburization processed member having a different carburizing condition to be processed next when the carburizing condition is changed;

renewing the carburization reference data by the new carburization reference data when the carburizing condition is changed;

detecting a temperature and a carbon potential at each position within a furnace at least during carburization and diffusion processes;

operating a carburized quantity of the carburization processed member at each position with reference to the detected temperature and carbon potential;

operating a carburization history of the carburization processed member by integrating the carburized quantity at each position of the carburization processed member; and determining a carburizing condition at a next carburization processing position depending on a difference between the carburization history at the time of terminating the carburization process at each position of the carburization processed member and the carburization reference data at said each position.

8. A method of controlling a continuous carburization furnace as set forth in claim 7, wherein the detecting step of the temperature and the carbon potential, the operating step of the carburized quantity of the carburization processed member, the operating step of the carburization history of the carburization processed member, and the determining step of the carburizing condition at the next carburization processing position are not executed when the vacant tray is at the carburizing position after the carburizing condition is changed.

9. A method of controlling a continuous carburization furnace as set forth in claim 7, further comprising the step of guarding the determined value of the carburizing condition at the next carburization processing position.

10. A method of controlling a continuous carburization furnace as set forth in claim 9, wherein the detecting step of the temperature and the carbon potential, the operating step of the carburized quantity of the carburization processed member, the operating step of the carburization history of the carburization processed member, the determining step of the carburizing condition at the next carburization processing position, and the guarding step of the determined value of the carburizing condition at the next carburization processing position are not executed when the vacant tray is at the carburizing position after the carburizing condition is changed.

11. A method of controlling a continuous carburization furnace as set forth in claim 7, wherein the heater temperature and the carbon potential at the first position of the carburization processing section are not changed even when the carburizing condition is varied.

12. A method of controlling a continuous carburization furnace as set forth in claim 7, wherein the heater temperature and the carbon potential at the first position of the carburization processing section are adjusted depending on the difference between the carbon integrated value and the carburized depth each operated at the first position of the carburization processing section and the carbon integrated reference value and the carburized depth reference value at the same position of the next member when the carburizing condition is varied.

* * * * *